US011713653B2

(12) United States Patent
Feluch et al.

(10) Patent No.: US 11,713,653 B2
(45) Date of Patent: Aug. 1, 2023

(54) SELF-POWERED WELLBORE MOTOR

(71) Applicant: BONA DEVELOPMENTS INC., Okotoks (CA)

(72) Inventors: Paul John Feluch, Okotoks (CA); Barry Dale Toppings, Calgary (CA)

(73) Assignee: BONA DEVELOPMENTS INC.

( * ) Notice: Subject to any disclaimer, the term of this patent is extended or adjusted under 35 U.S.C. 154(b) by 362 days.

(21) Appl. No.: 15/994,355

(22) Filed: May 31, 2018

(65) Prior Publication Data

US 2018/0347319 A1 Dec. 6, 2018

Related U.S. Application Data

(60) Provisional application No. 62/513,140, filed on May 31, 2017.

(51) Int. Cl.

| | |
|---|---|
| ***E21B 41/00*** | (2006.01) |
| ***E21B 47/14*** | (2006.01) |
| ***E21B 43/12*** | (2006.01) |
| ***E21B 47/26*** | (2012.01) |

(52) U.S. Cl.

CPC ..... *E21B 41/0085* (2013.01); *E21B 43/126* (2013.01); *E21B 47/14* (2013.01); *E21B 47/26* (2020.05)

(58) Field of Classification Search

CPC .... E21B 41/0085; E21B 47/26; E21B 43/126; E21B 47/008; E21B 47/16

See application file for complete search history.

(56) References Cited

U.S. PATENT DOCUMENTS

| | | | | |
|---|---|---|---|---|
| 3,437,992 A * | 4/1969 | Johnston | ..... | E21B 47/06 340/854.5 |
| 5,050,132 A | 9/1991 | Duckworth | | |
| 5,166,908 A * | 11/1992 | Montgomery | ..... | E21B 47/26 367/165 |
| 5,477,505 A | 12/1995 | Drumeller | | |
| 6,899,178 B2 | 5/2005 | Tubel | | |

(Continued)

FOREIGN PATENT DOCUMENTS

| | | | | |
|---|---|---|---|---|
| GB | 2433753 A * | 7/2007 | ..... | H01L 35/30 |
| WO | WO-2013093445 A2 * | 6/2013 | ..... | H04B 11/00 |

(Continued)

OTHER PUBLICATIONS

"Acoustic" definition. Available from: https://www.thefreedictionary.com/acoustic (Year: 2020).*

(Continued)

*Primary Examiner* — Theodore N Yao
(74) *Attorney, Agent, or Firm* — Ridout & Maybee LLP

(57) ABSTRACT

A well monitor for monitoring a downhole well condition. The well monitor comprises an electrical generator mounted to a tubing in the well, the generator comprising magnets and windings movable relative to one another by a pump rod received in the tubing. The monitor comprises an energy storage device electrically coupled to the generator for storing generated electrical energy. A vibration transducer is electrically coupled to the energy storage device. The well monitor comprises a controller for selectively powering the vibration transducer to produce a signal indicative of the well condition for transmission through the tubing.

38 Claims, 18 Drawing Sheets

(56) References Cited

U.S. PATENT DOCUMENTS

| | | | | |
|---|---|---|---|---|
| 8,009,059 | B2 * | 8/2011 | Huang | E21B 47/14 340/853.3 |
| 2005/0024231 | A1 * | 2/2005 | Fincher | E21B 41/0085 340/854.4 |
| 2006/0016606 | A1 | 1/2006 | Tubel | |
| 2009/0169364 | A1 * | 7/2009 | Downton | E21B 41/0085 415/118 |
| 2010/0133833 | A1 * | 6/2010 | Williams | E21B 4/02 290/50 |
| 2010/0157741 | A1 * | 6/2010 | Drumheller | G01V 1/523 367/162 |
| 2010/0208552 | A1 * | 8/2010 | Camwell | E21B 47/16 367/82 |
| 2011/0037004 | A1 | 2/2011 | Lake | |
| 2014/0158347 | A1 * | 6/2014 | Fielder | E21B 47/009 166/250.01 |
| 2014/0265580 | A1 * | 9/2014 | Cooley | F03G 7/08 307/47 |
| 2019/0226330 | A1 * | 7/2019 | Xiao | B06B 1/0611 |

FOREIGN PATENT DOCUMENTS

| | | | | |
|---|---|---|---|---|
| WO | WO-2015187165 | A1 * | 12/2015 | E21B 47/095 |
| WO | WO-2018010015 | A1 * | 1/2018 | E21B 47/26 |

OTHER PUBLICATIONS

"Sound" definition. Available from: https://www.thefreedictionary.com/acoustic (Year: 2020).*

* cited by examiner

SELF-POWERED WELLBORE MOTOR

FIELD

The present disclosure relates to well operation, in particular, to operation of powered downhole equipment.

BACKGROUND

Production wells may be drilled into oil bearing zones of a subterranean formation to produce oil. An artificial lift system, such as a progressive cavity pump system, or a sucker rod pump system, may be installed in the production well to produce oil. Optimal operational conditions such as pumping speed may depend on the production fluid level in the production well.

Various systems have been developed for identifying the production fluid level in the production well. Unfortunately, existing systems may operate at limited depths, which limit the ability for the existing systems to identify the production fluid level. In addition, existing systems may have limited life span as they are powered by energy sources that become depleted over time and that do not themselves generate energy, such as batteries. Moreover, existing systems may need to be installed during drilling and completion of the production well, and may not be retrofitted to an existing production well. Further, existing systems may be expensive and time-consuming to install, may be fragile, and may be susceptible to damage during operation or maintenance of the artificial lift system.

SUMMARY

Disclosed herein is a well monitor for monitoring a downhole well condition, comprising: an electrical generator mounted to a tubing in the well, the generator comprising magnets and windings movable relative to one another by a pump rod received in the tubing; an energy storage device electrically coupled to the generator for storing generated electrical energy; a vibration transducer electrically coupled to the energy storage device; and a controller for selectively powering the vibration transducer to produce a signal indicative of the well condition for transmission through the tubing.

Disclosed herein is a method of monitoring a downhole well condition of a wellbore, the method comprising: generating electrical current at a generator mounted in the wellbore, by cyclical motion of a pump rod; charging an energy storage device with the electrical current; and selectively powering a vibration transducer to produce a signal indicative of the well condition for transmission through the tubing.

Disclosed herein is a well monitor for monitoring a downhole well condition, comprising: an electrical generator mounted to a tubing in the well, the generator comprising magnets moveable relative to windings by a pump rod received in the tubing; an energy storage device electrically coupled to the generator for storing electrical energy generated by the electrical generator; a vibration transducer electrically coupled to the energy storage device; and a controller for selectively powering the vibration transducer with the electrical energy stored in the energy storage device to produce a signal indicative of the well condition for transmission through the tubing.

Many further features and combinations thereof concerning embodiments described herein will appear to those skilled in the art following a reading of the instant disclosure.

BRIEF DESCRIPTION OF DRAWINGS

In the figures which illustrate example embodiments.

DETAILED DESCRIPTION

As used herein, the terms "up", "upward", "upper", or "uphole", refer to positions or directions in closer proximity to the surface and further away from the bottom of a wellbore, when measured along the longitudinal axis of the wellbore. The terms "down", "downward", "lower", or "downhole" refer to positions or directions further away from the surface and in closer proximity to the bottom of the wellbore, when measured along the longitudinal axis of the wellbore.

A well monitor and a method for its use are disclosed. The well monitor may be integrated with a tubing of a production well. The well monitor generates its own electrical energy based on relative movement of magnets and windings. The magnets may be mounted onto a rod of a rod string for an artificial lift system, like a reciprocating pump or a sucker rod pump, and the windings may be mounted onto the well monitor. The well monitor comprises an energy storage device, such as a capacitor bank and a battery bank, for storing the generated electrical energy. Further, the well monitor comprises sensors for detecting the well conditions of the production well, such as annulus pressure and pump discharge pressure. In addition, the well monitor comprises a piezoelectric transducer, which generates a stress wave that traverses through the tubing when it is charged with electrical energy. The well monitor is configured to communicate the well conditions of the production well to a surface receiver by selectively charging the piezoelectric transducer with the electrical energy stored in the energy storage device to generate stress waves representative of the well conditions. The surface receiver detects the stress waves traversing through the tubing and decodes the stress waves into the well conditions.

Figure 1:
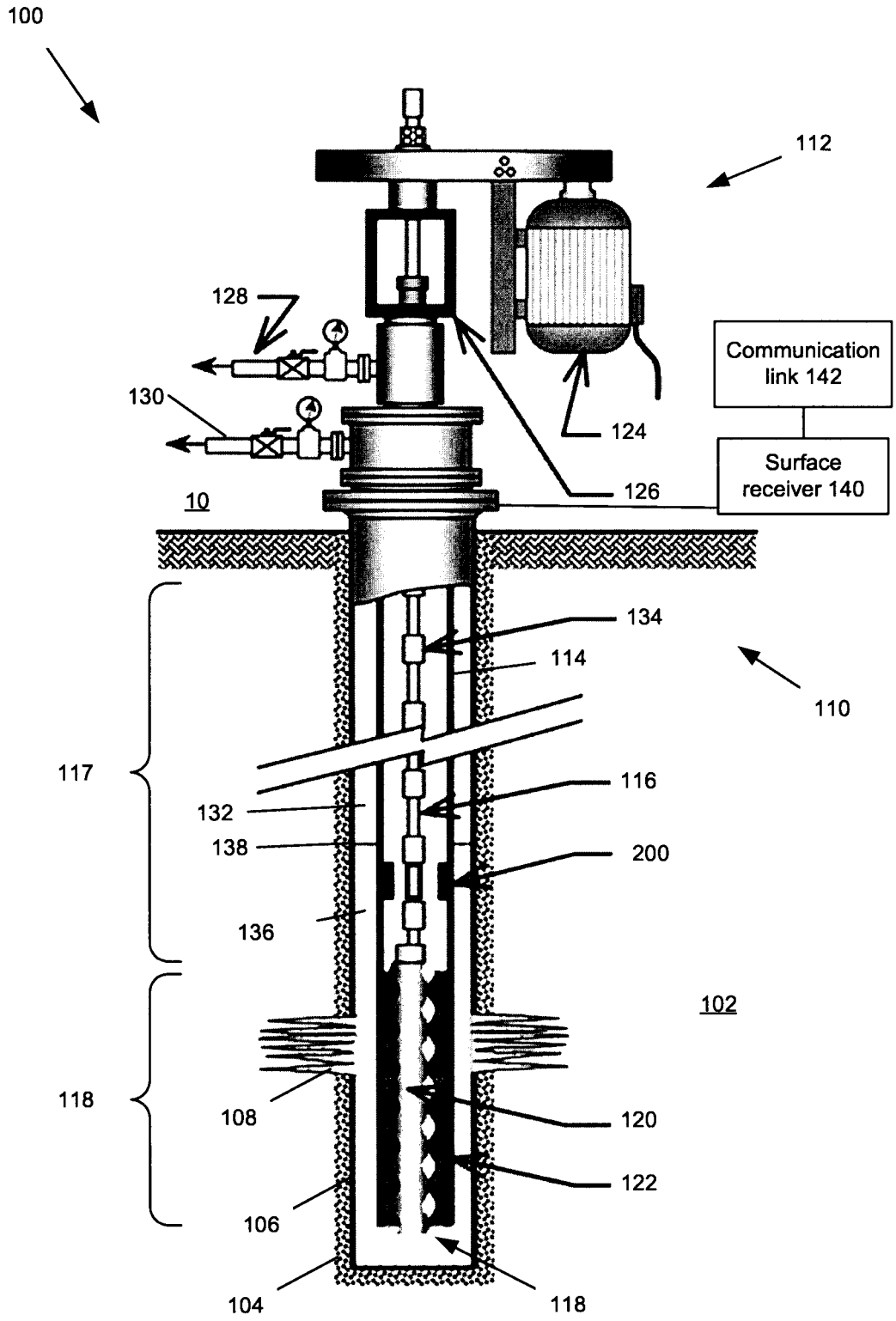
FIG. 1 is a schematic of a system comprising a well monitor integrated with an artificial lift system for conducting fluid from an oil bearing zone to a surface.

FIG. 1 depicts a system 100 for conducting fluid from an oil bearing formation 102 to a surface 10. In some embodiments, conducting the fluid from the oil bearing formation 102 to the surface 10 via a wellbore 104 is for effecting production of hydrocarbon material from the oil bearing formation 102. In some embodiments, the oil bearing formation 102, whose hydrocarbon material is being produced by the producing via the wellbore 104, has been, prior to the producing, stimulated by the supplying of treatment material to the hydrocarbon material-containing reservoir.

Wellbore 104 of a production well is encased with a casing 106. The casing 106 may be provided for supporting the subterranean formation within which the wellbore 104 is disposed. The casing 106 may comprise multiple segments, and segments may be connected together, such as by threaded connection.

The casing 106 comprises perforations 108, such that the wellbore 104 is in fluid communication with the oil bearing formation 102. The system 100 further comprises an artificial lift system 110 to promote production of the hydrocarbon material from the oil bearing formation 102. As depicted in FIG. 1, the artificial lift system 110 is a progressive cavity pump system. In some embodiments, other artificial lift systems 110 may be used in the system 100 to conduct fluid from the oil bearing formation 102 to the surface 10, such as sucker rod pumping, gas lift, plunger lift, electrical submersible pumping, and the like.

The artificial lift system 110 as depicted in FIG. 1 comprises a wellhead 112 at the surface 10, a tubing 114, a plurality of rods 116 coupled together to define a rod string 117, and a pump 118. Where the artificial lift system 110 is a progressive cavity pump, the pump 118 comprises a pump rotor 120 and a pump stator 122.

In some embodiments, the wellhead 112 comprises equipment for suspending the rod string 117, delivering axial and torsional loads to the rod string 117, and directing the fluids produced from the oil bearing formation 102 for further processing and storage. In some embodiments, as depicted in FIG. 1, the wellhead 112 and the wellbore 104 are generally aligned along a common axis extending through the center of the wellhead 112 and the center of the wellbore 104. A prime mover 124, a wellhead drive 126, and flow lines 128 and 130 are located at the surface 10.

The prime mover 124, for example, an internal combustion engine, an electric motor, or hydraulic motor, is coupled to and drives the surface equipment and the pump 118. The prime mover 124 is coupled to the wellhead drive 126, for example, via a power transmission system that may comprise hydraulic systems, belts and sheaves, and a gear box. In some embodiments, the wellhead drive 126 comprises a hollow shaft or an integral shaft design, such as a polish rod, for coupling with the rod string 117. The wellhead drive 126 supports the axial and torsional load applied to the wellhead 112 by the rod string 117.

The tubing 114 is coupled to the wellhead 112 and received inside the casing 106 within the wellbore 104, such that the tubing 114 and the casing 106 define an annular passage 132 therebetween. The fluid from the oil bearing reservoir 102 is conducted to the surface 10 via the tubing 114.

The rod string 117 comprises a series of rods 116, coupled together with couplings 134. In some embodiments, the couplings 134 are threaded couplings and the rods 116 have complementary threaded ends for threading to the couplings 134. One end of the rod string 117 is connected to the wellhead drive 126 of the wellhead 112, and the other end of the rod string 117 is connected to the pump 118. Where the pump 118 is a progressive cavity pump, the rod string 117 is connected to the helical rotor of the pump 118. The rod string 117 is received in the tubing 114. In some embodiments, as depicted in FIG. 1, the rod string 117 and the tubing 114 are generally aligned along a common axis extending through the center of the rod string 117 and the center of the tubing 114. In some embodiments, the rod string 117 may be a continuous rod string of unitary structure.

As depicted in FIG. 1, the pump 118 is deployed at the bottom of the wellbore 104. In some embodiments, the pump 118 is a progressive cavity pump. In such embodiments, the pump rotor 120 of the pump 118 is a helical rotor, and the pump stator 122 of the pump 118 comprises a tubular housing defining an internal helical cavity complementary to the helical rotor. The helical rotor is configured to be received and rotate within the helical cavity of the stator. When the helical rotor is received in the helical cavity of the stator, the helical rotor is sealingly engaged with the stator, and the helical rotor and the stator further define a plurality of discrete chambers for containing fluid to be pumped through the tubing 114 to the surface 10. The rotation of the helical rotor within the stator effects pumping of the fluid in the discrete chambers through the tubing 114 to the surface 10.

As depicted in FIG. 1, the flow line 128 is in fluid communication with the tubing 114. The flow line 128 is configured to direct fluid in the tubing 114 to a facility for further processing or storage (not shown). Further, the flow line 130 is in fluid communication with the annular passage 132. The flow line 130 is configured to direct the fluid in the annular passage 132 to a facility for further processing or storage (not shown).

To conduct fluid from the wellbore 104 to the surface 10 using the system 100 as depicted in FIG. 1, the fluid is pumped up through the tubing 114 by the pump 118. Fluid from the oil bearing formation 102 flows through the perforations 108 into the wellbore 104. The fluid flowing into the wellbore 104 flows into the annular passage 132. The fluid in the annular passage 132 is annulus fluid 136 that comprises an annulus fluid level 138. The prime mover 124, the wellhead drive 126, and the rod string 117 are cooperatively configured such that the power generated by the prime mover 124 is translated into a force to move the rod string 117 within the tubing 114.

Where the artificial lift system 110 is a progressive cavity pump system, as depicted in FIG. 1, the prime mover 124, the wellhead drive 126, the rod string 117, the pump rotor 120, and the pump stator 122 are cooperatively configured such that the power generated by the prime mover 124 is translated into a rotational force to rotate the pump rotor 120 relative to the pump stator 122. As the pump rotor 120 rotates relative to the pump stator 122, fluid contained in the discrete chambers defined by the pump rotor 120 and the pump stator 122 are conducted through the tubing 114 to the surface 10. In some examples, where the pump 118 is a progressive cavity pump, the rod string 117 rotates between 50 to 600 rotations per minute. In some examples, where the pump 118 is a progressive cavity pump, the rod string 117 rotates between 100 to 500 rotations per minute. In some examples, where the fluid is light oil, the rod string 117 rotates between 200 to 500 rotations per minute. In some examples, where the fluid is heavy oil, the rod string 117 rotates between 100 to 250 rotations per minute.

Where the artificial lift system 110 is a sucker rod pump system, the prime mover 124, the wellhead drive 126, and the rod string 117 are cooperatively configured such that the power generated by the prime mover 124 is translated into a reciprocating motion along the length of the tubing 114 to reciprocally move the pump 118 upwards and downwards within the wellbore 104. As the pump 118 moves in the tubing 114, the pump 118 draws in the fluid during the down stroke, and pumps the fluid to the surface 10 during the up stroke.

The efficiency of the fluid production by the system 100 may be improved by controlling the rate of the fluid production (e.g. the rate at which the pump 118 pumps the fluid to the surface 10). This may be controlled by adjusting the speed with which the rod string 117 moves (e.g. angular velocity of a rotating rod string 117). In some embodiments, the rate of fluid production by the system 100 that may improve the efficiency of the fluid production by the system 100 is a function of the annulus fluid level 138. In some embodiments, the annulus fluid level 138 is determined based on the well conditions of the wellbore, such as the pressure in the annular passage 132.

As depicted in FIG. 1, the system 100 comprises an example well monitor 200 for monitoring well conditions of the wellbore 104. The well monitor 200 is deployed in the wellbore 104 and is integrated with and forms part of the tubing 114. The well monitor 200 is positioned on the tubing 114 such that the well monitor 200 is downhole of the wellhead 112 and uphole of the pump 118. The well monitor 200 comprises sensors for detecting well conditions (e.g. pressure, temperature) of the wellbore 104, and the well monitor 200 is configured to send encoded signals indicative of the well conditions to the surface 10, where the encoded signals are received by a surface receiver 140 and decoded.

Figure 2:
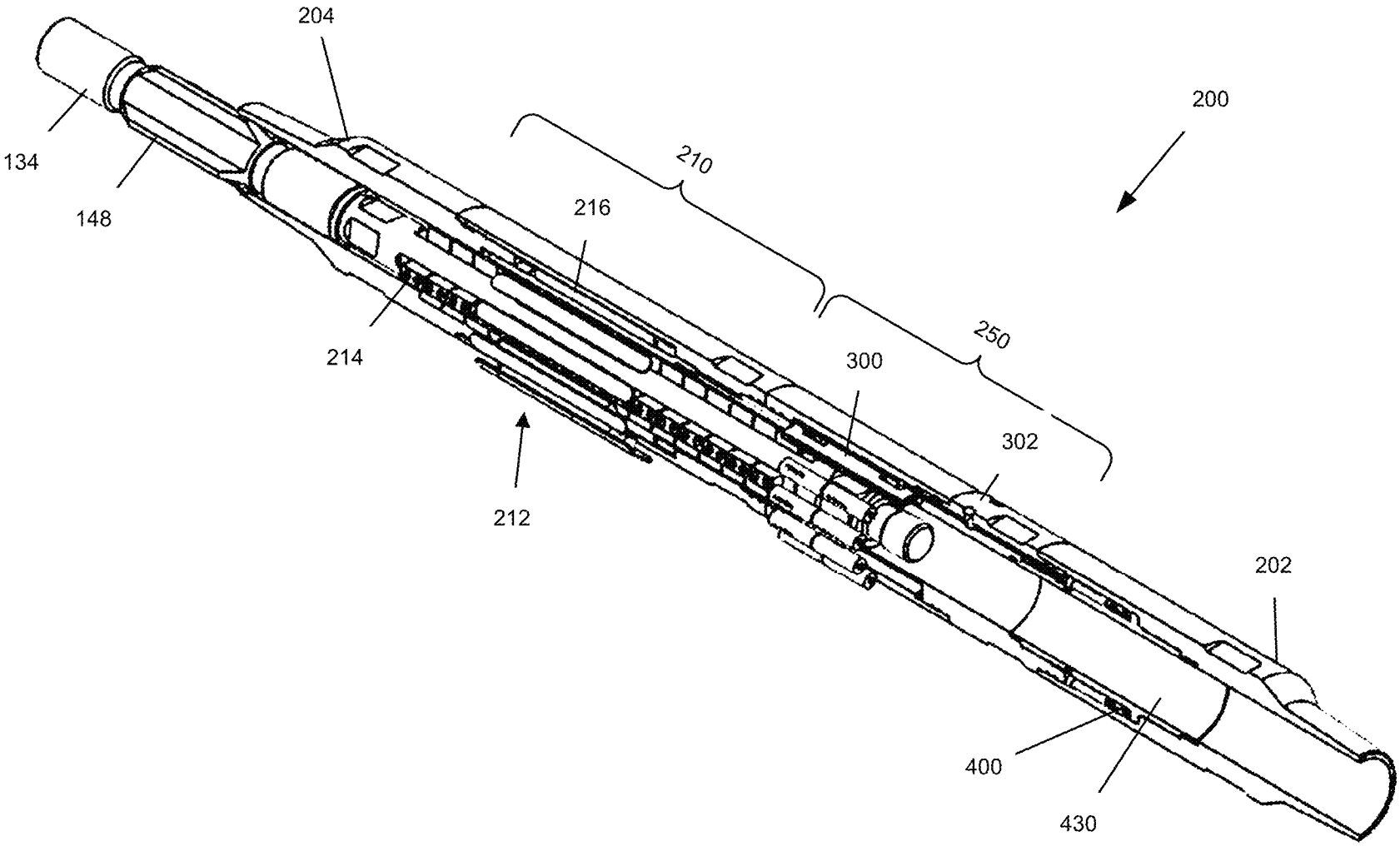
FIG. 2 is a perspective cutaway view of the well monitor of FIG. 1.

FIG. 2 is a perspective cutaway view of the well monitor 200. In some embodiments, the well monitor 200 comprises an uphole collar 202 and a downhole collar 204. The uphole collar 202 is configured to couple an uphole end of the well monitor 200 with an uphole portion of the tubing 114. The downhole collar 204 is configured to couple a downhole end of the well monitor 200 to a downhole portion of the tubing 114. The well monitor 200, the uphole portion of the tubing 114, and the downhole portion of the tubing 114, when coupled together, define the tubing 114 through which fluid from the oil bearing formation 102 is conducted and produced at the surface 10. When the well monitor 200 is deployed in the wellbore 104 to monitor the well conditions of the wellbore 104, the well monitor 200 is integral to the tubing 114, such that fluid pumped from the pump 118 through the tubing 114 will be conducted through the well monitor 200 to be produced at the surface 10. Further, when the well monitor 200 is deployed in the wellbore 104, the rod string 117 is received through the well monitor 200. In some examples, the length of the well monitor 200 is approximately 6 feet. In some examples, the well monitor 200 is mounted one tubing joint up from the pump 118. In some embodiments, the well monitor 200 is mounted with the tubing 114 while the well is being completed or when service is done to an existing well.

In some examples, the casing 106 of the wellbore 104 is a 7" casing, with internal diameter between 5.92" and 6.538". In some examples, the casing 106 of the wellbore 104 is a 5.5" casing, with internal diameter between 4.67" and 5.044". In some examples, the tubing 114 is a 2⅞" tubing with an internal diameter between 2.259" to 2.441". In some examples, the tubing 114 is a 3½" tubing with an internal diameter between 2.750" to 3.068".

In some embodiments, the well monitor 200 comprises an electric generator assembly 210, an electronics mandrel assembly 250 comprising an energy storage device that is electrically coupled to the electric generator assembly 210, and a vibration transducer 400 electrically coupled to the electronics mandrel assembly 250. When the well monitor 200 is deployed in the wellbore 104, the electric generator assembly 210 is positioned downhole relative to the electronics mandrel assembly 250 and the vibration transducer 400, the vibration transducer 400 is positioned uphole relative to the electric generator assembly 210 and the electronics mandrel assembly 250, and the electronics mandrel assembly 250 is positioned between electric generator assembly 210 and the vibration transducer 400.

The electric generator assembly 210 comprises an electrical generator 212. The electrical generator 212 comprises magnets 214 and windings 216 movable relative to one another by the rod string 117. The electric generator assembly 210 of the well monitor 200 generates electrical energy based on relative movement of the rod string 117 and the electric generator assembly 210. In some embodiments, the rod string 117 has a cyclical motion, such as a rotation about a central axis of the rod string 117 (e.g. when the artificial lift system 110 is a progressive cavity pump), or a reciprocating up and down motion (e.g. when the artificial lift system 110 is a sucker rod pump).

Figure 3:
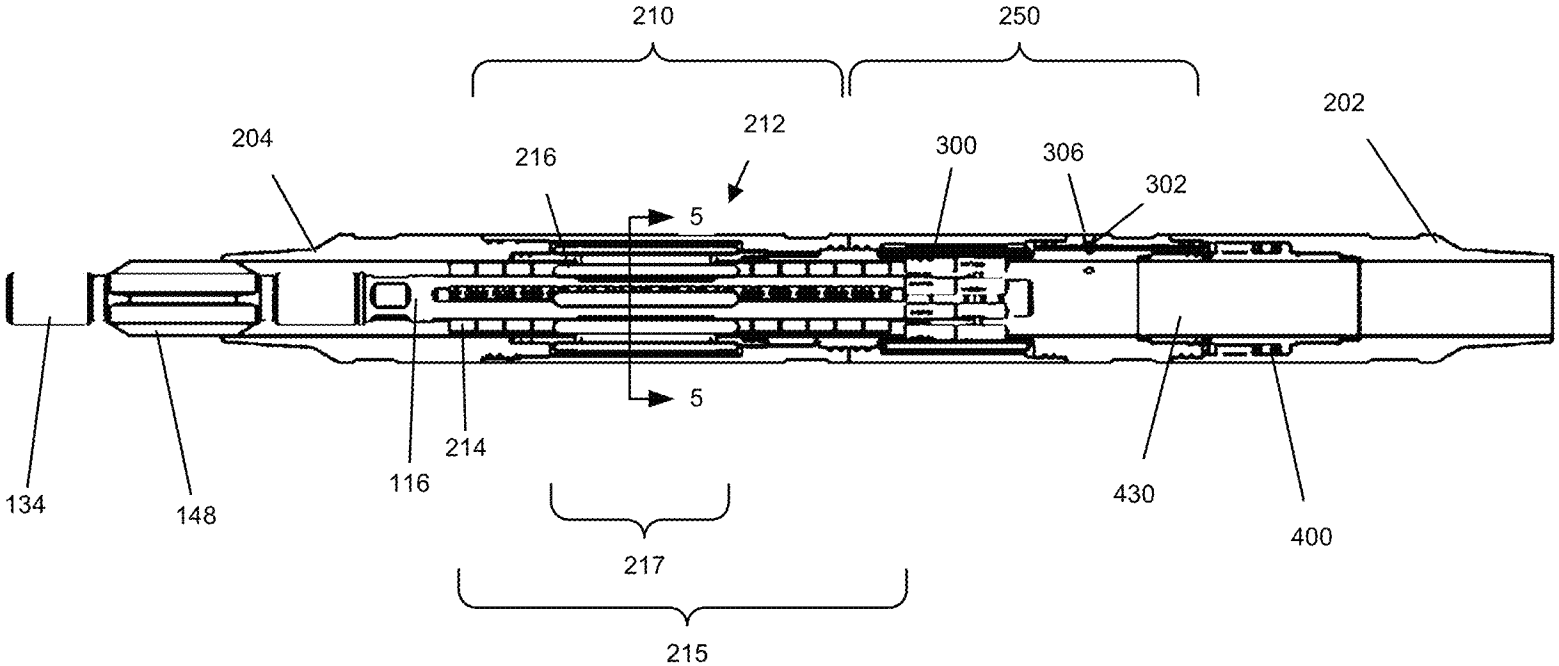
FIG. 3 is a cross-sectional view of the well monitor of FIG. 2.
Figure 4A:
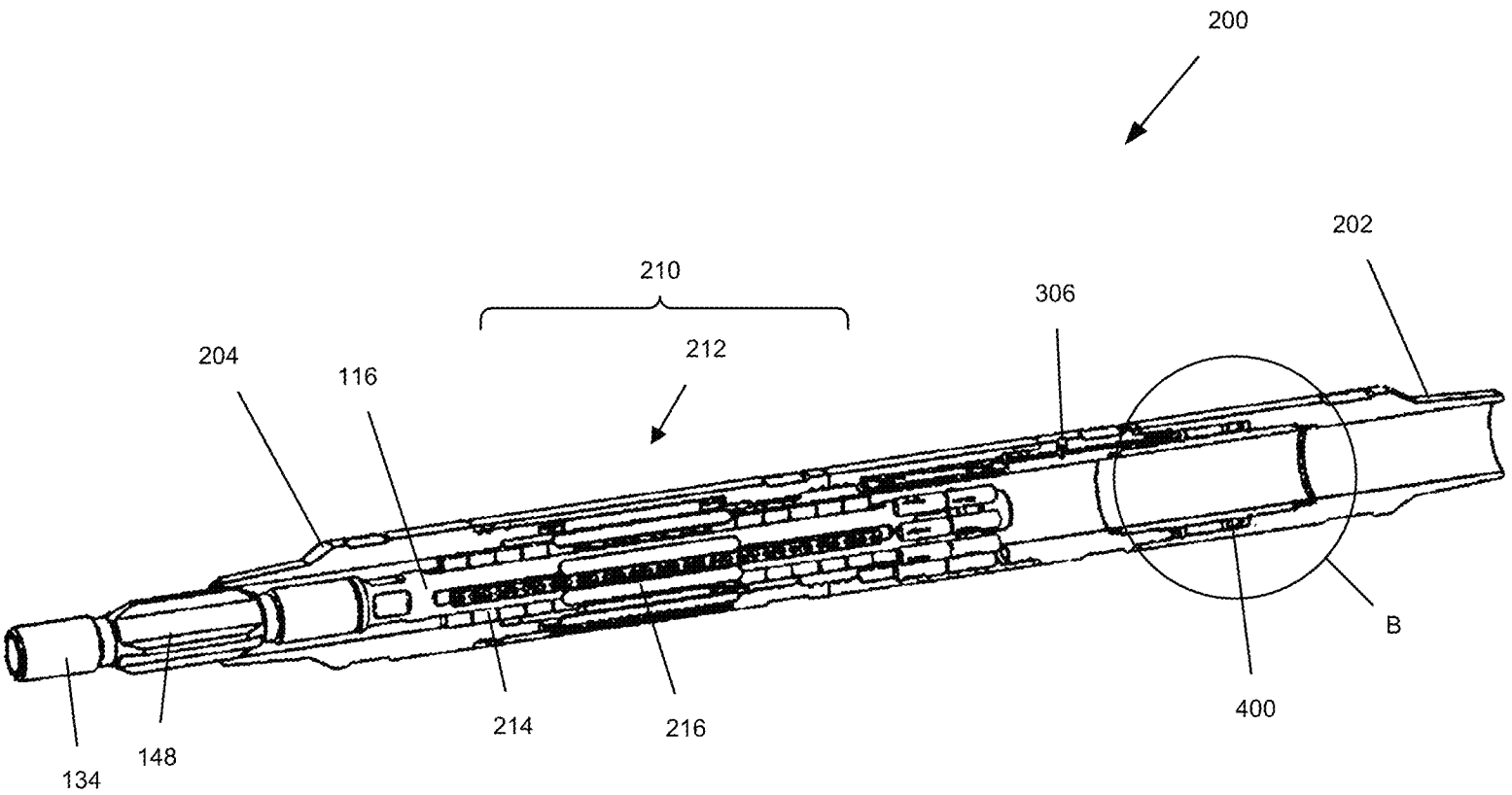
FIG. 4A is a perspective cutaway view of the well monitor of FIG. 2, depicting the electric generator assembly and the rod string with an uphole centralizer and a downhole centralizer mounted thereon.

FIG. 3 depicts a cross-sectional view of the well monitor 200, depicting the electric generator assembly 210 and a rod 116 of the rod string 117 received in the electric generator assembly 210. FIG. 4A depicts a perspective cutaway view of the electric generator assembly 210 and the rod 116 with an uphole centralizer 146 and a downhole centralizer 148 mounted thereon.

In some embodiments, the well monitor 200, such as the one depicted in FIG. 2, FIG. 3, and FIG. 4A, is used in the wellbore 104 with the artificial lift system 110 where the pump 118 is a progressive cavity pump, as depicted in FIG. 1. In such embodiments, the magnets 214 of the well monitor 200 are mounted on the rod 116, and the windings 216 are mounted around and wound about the circumference of the electric generator assembly 210 and encircling the magnets 214, such that the magnets 214 are movable relative to the windings 216. The electrical energy generated by the electrical generator 212 is due to the movement of the magnets 214 mounted on the rod 116 relative to the windings 216.

In some embodiments, the magnets 214 are mounted on the rod 116 such that the mounted magnets 214 define rows of magnets 214 extending along the axis of rod 116. The magnets 214 may be mounted to the rod 116 using screws, for example. As depicted in FIG. 2, FIG. 3, and FIG. 4A, the magnets 214 are mounted to the rod 116 in four rows, generally evenly spaced apart, for example, by 90 degrees, around the rod 116. In some examples, the magnets 214 may have a magnetic flux density or magnetic induction of 13200 or more Gauss. In some examples, the rod 116 is approximately 1 foot to 2 feet in length.

Each row of magnets 214 may extend along a certain length 215 along the rod 116. The length 215 of the row of magnets 214 may be the same as other rows of magnets 214, or each row of magnets 214 may have its own length 215. As depicted in FIG. 3, each row of magnets 214 has the same length 215. In some examples, each row of magnets 214 comprises 16 magnets 214 that are each 1" in length. In some embodiments, a longitudinal dimension 217 of the windings 216, as depicted in FIG. 3, is shorter than the length 215 of the row of magnets 214. This may allow the windings 216 to be consistently exposed to the magnetic field of the magnets 214 when the magnets 214 mounted on the rod 116 move relative to the windings 216.

Figure 5:
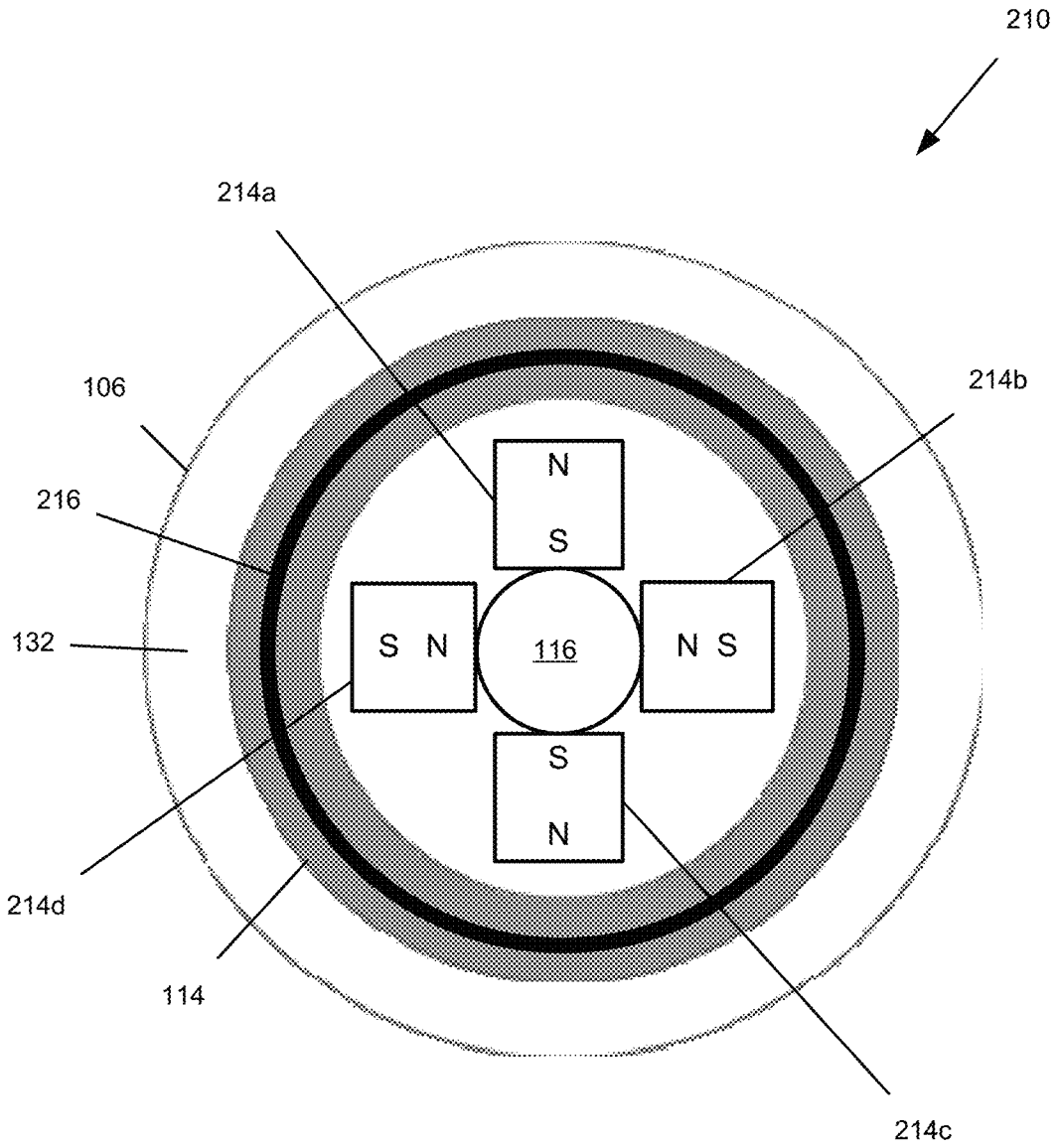
FIG. 5 is a schematic of a cross-sectional view of the electric generator assembly of the well monitor of FIG. 2 along line 5-5 shown in FIG. 3.

FIG. 5 depicts a schematic of a cross-sectional view of the electric generator assembly 210 of the well monitor 200 along line 5-5 shown in FIG. 3. FIG. 5 depicts the configuration of the magnets 214 of the electric generator assembly 210. As depicted in FIG. 5, the magnets 214 are mounted to and around the rod 116, such that each magnet 214 is adjacent two other magnets 214. For example, the magnet 214*a* is adjacent to the magnets 214*b* and 214*d*. Adjacent magnets 214 have opposite poles facing towards the windings 216. For example, the north pole of the magnet 214*a* and the magnet 214*c* are proximate the windings 216, and the north pole of the magnet 214*b* and the magnet 214*d* are proximate the rod 116. In some examples, the distance between the outermost point of a magnet 214 and the center of the rod 116 is 1".

As depicted in FIG. 2, FIG. 3, FIG. 4A, and FIG. 5, when the rod string 117 is received through the well monitor 200, the rod string 117 is not directly coupled to the electric generator assembly 210, such that the rod 116 and the rod string 117 is free to move relative to the electric generator assembly 210, and such that the magnets 214 and windings 216 are movable relative to one another. For example, where the pump 118 is a progressive cavity pump, the rod 116 is free to rotate relative to the electric generator assembly 210. As another example, where the pump 118 is a sucker rod pump, the rod 116 is free to reciprocally move up and down relative to the electric generator assembly 210. In some embodiments, the rod string 117 may be withdrawn from the electric generator assembly 210 and from the tubing 114 as needed, such as for setting and servicing, for pump seating, for adjusting the rod height, and retrieving the pump.

In some embodiments, where the well monitor 200 is integral with the tubing 114, the fluid conducted to the surface 10 from the oil bearing formation 102 flows through the electric generator assembly 210. The fluid may contact the magnets 214 as the fluid flows through the electric generator assembly 210. In some embodiments, the magnets 214 may be coated, such as with an overmold of polyurethane or a similar material, to protect the magnets 214 from the fluid being conducted to the surface 10.

In some embodiments, one or more centralizers may be mounted to the rod 116 to maintain clearance between the rod 116 and the well monitor 200. Where centralizers 146 and 148 are mounted to the rod 116 or the coupling 134, a surface of the centralizers 146 and 148 facing the inner surface of the well monitor 200 may have a coating, for example, a urethane, plastic, or elastomer coating, and the like, to reduce frictional wear between the centralizers 146 and 148 and the well monitor 200. In some embodiments, the centralizers 146 and 148 are mounted on the well monitor 200, such that the rod 116 is free to rotate within the centralizers 146 and 148. In some examples, the centralizers 146 and 148 are spin-through centralizers. As depicted in FIG. 4A, the uphole centralizer 146 is mounted onto the rod 116 uphole of the magnets 214. As depicted in FIG. 4A, the downhole centralizer 148 is mounted onto the rod 116 downhole of the magnets 214. In some embodiments, the centralizers 146 and 148 are mounted to the rod 116 or the coupling 134, and rotate relative to the well monitor 200.

In some embodiments, where the magnets 214 are mounted to the rod 116, the inner wall of the well monitor 200, such as of the electric generator assembly 210, is manufactured with a non-magnetic material to reduce the attraction of the magnets 214 to the well monitor 200. In some examples, the non-magnetic material is beryllium copper, 316 stainless steel, or ToughMet™.

In some embodiments, a shaft assembly comprising the polish rod and the rods 116 extend from the surface 10 to the artificial lift system 110. The rod 116 on which the magnets 214 are mounted may be a pony rod for aligning the magnets 214 and the windings 216 of the electric generator assembly 210.

In some examples, the windings 216 comprise a 12 slot, 4 pole, 3 phase, constant pitch, winding in a Delta configuration. In some examples, the windings 216 may be in a Y-configuration.

In some embodiments, the electric generator assembly 210 comprises one or more Hall Effect sensors. The Hall Effect sensors may be mounted proximate to the windings 216. In some embodiments, the Hall Effect sensors are mounted along the well monitor 200, such as on the electric generator assembly 210, the electronics mandrel assembly 250, or proximate the vibration transducer 400. The Hall Effect sensors may be configured to detect the magnetic field of the magnets 214, and may be configured to generate and send a signal representative of the magnets 214 being in a position or a range of positions relative to the position of the Hall Effect sensors. The signal may be used as feedback to align the rod 116 such that the magnets 214 are proximate to the windings 216.

The well monitor 200 comprises an electronics mandrel assembly 250 for storing the electrical energy generated by the electrical generator assembly 210. From the stored electrical energy, a sufficient voltage may be applied to the vibration transducer 400 to selectively power the vibration transducer 400 to produce a signal indicative of a wellbore condition. The electric generator assembly 210 is electrically coupled to the electronics mandrel assembly 250. In some embodiments, the electronics mandrel assembly 250 comprises an energy storage device, such as a capacitor bank 256, a battery bank 260, or the like, that is electrically coupled to the electric generator 212 for storing the generated electrical energy. In some embodiments, the electronics mandrel assembly 250 comprises a controller 300 for selectively powering the vibration transducer 400 to produce a signal indicative of a wellbore condition.

Figure 6:
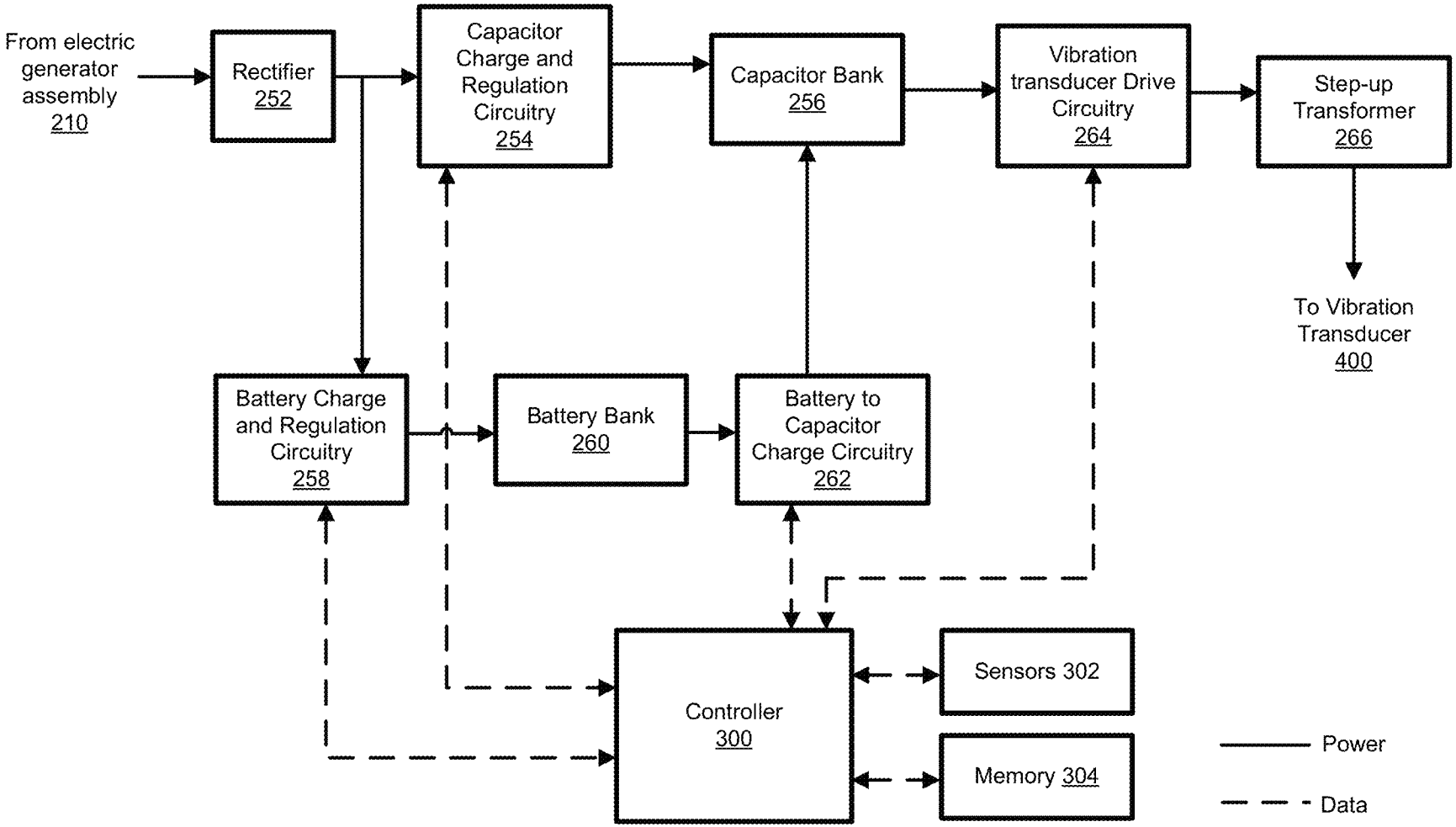
FIG. 6 is a block diagram of the power and controls components of the electronics mandrel assembly of the well monitor of FIG. 2.

FIG. 6 is a block diagram of the power and controls components of the electronics mandrel assembly 250 of the well monitor 200. As noted in FIG. 6, the solid lines arrows indicate electric communication, and the dashed lines indicate data communication.

In some embodiments, the electronics mandrel assembly 250 comprises a rectifier 252. The rectifier 252 is electrically coupled to the electric generator assembly 210, and further electrically coupled to a capacitor charge and regulation circuitry 254 and a battery charge and regulation circuitry 258. The rectifier 252 is configured to convert alternating current that may be generated by the electric generator 212 to direct current. The current that has been converted by the rectifier 252 may be controlled by the controller 300 to flow from the rectifier 252 to the capacitor charge and regulation circuitry 254 or the battery charge and regulation circuitry 258 to charge the energy storage device, such as the capacitors of the capacitor bank 256 or the batteries of the battery bank 260.

The electronics mandrel assembly 250 comprises circuitry for controlling when the energy storage device of the well monitor 200 is charged by the electrical energy generated by the electric generator assembly 210. As depicted in FIG. 6, the electronics mandrel assembly 250 comprises the capacitor charge and regulation circuitry 254 for regulating when the capacitor bank 256 is charged. The capacitor charge and regulation circuitry 254 is electrically coupled to the rectifier 252 and the capacitor bank 256.

The capacitor charge and regulation circuitry 254 may be configured to electrically connect or disconnect the rectifier 252 and the capacitor bank 256. When the rectifier 252 and the capacitor bank 256 is electrically disconnected, electrical energy from the rectifier 252 may not be conducted to the capacitor bank 256 to charge the capacitors of the capacitor bank 256. When the rectifier 252 and the capacitor bank 256 is electrically connected, electrical energy from the rectifier 252 may be conducted to the capacitor bank 256 to charge the capacitors of the capacitor bank 256.

The capacitor charge and regulation circuitry 254 is connected in data communication with the controller 300. In some embodiments, the capacitor charge and regulation circuitry 254, in response to a control command from the controller 300, is configured to send a signal corresponding to the status of the capacitor charge and regulation circuitry 254 or the capacitor bank 256 to the controller 300. In some embodiments, the capacitor charge and regulation circuitry 254, in response to a control command from the controller 300, is configured to disconnect the rectifier 252 and the capacitor bank 256, or connect the rectifier 252 and the capacitor bank 256.

In some embodiments, the capacitor charge and regulation circuitry 254 is configured to generate signals that corresponds to the status of the capacitor charge and regulation circuitry 254 or the capacitor bank 256, such as the connection between the rectifier 252 and the capacitor bank 256, the amount of charge in the capacitor bank 256, whether the capacitor bank 256 is being charged, and the source from which the capacitor bank 256 is being charged.

In some embodiments, the electronics mandrel assembly 250 comprises an energy storage device that is electrically coupled to the electric generator assembly 210 for storing the generated energy. The energy storage device is also electrically coupled to the vibration transducer 400. As depicted in FIG. 6, the electronics mandrel assembly 250 comprises the capacitor bank 256. The capacitor bank 256 is electrically coupled to the capacitor charge and regulation circuitry 254 for receiving electrical energy from the rectifier 252 if the capacitor charge and regulation circuitry 254 is connecting the rectifier 252 and the capacitor bank 256. In some examples, the capacitor bank 256 is charged to 8.2 volts.

In some embodiments, the capacitors of the capacitor bank 256 are supercapacitors.

In some examples, the capacitor bank 256 comprises 12 22F supercapacitors (29.3 Farad). The supercapacitors may be mounted on one or more circuit boards that may be mounted onto the electronics mandrel assembly 250. The one or more circuit boards may be potted in a rubber compound and fit inside pockets defined by the electronics mandrel assembly 250. The one or more circuit boards may be covered by a sleeve such that they are sealed at atmospheric pressure, and protected from the pressurized environment in the tubing 114 and annulus 132, and protected from the fluids flowing through the tubing 114 and the annulus 132.

In some examples, the capacitors of the capacitor bank 256 operate at a temperature of approximately 150° C. or greater.

In some embodiments, the well monitor 200 comprises more than one energy storage device. Each of the energy storage devices of the well monitor 200 may be charged by the electrical energy generated by the electric generator assembly 210. In some embodiments, the electronics mandrel assembly 250 comprises circuitry for controlling when the energy storage devices of the well monitor 200 are charged by the electrical energy generated by the electric generator assembly 210.

As depicted in FIG. 6, the electronics mandrel assembly 250 comprises the battery charge and regulation circuitry 258 and the battery bank 260, in addition to the capacitor charge and regulation circuitry 254 and the capacitor bank 256. The battery charge and regulation circuitry 258 is for regulating when the battery bank 260 is charged. The battery charge and regulation circuitry 256 is electrically coupled to the rectifier 252 and the battery bank 260.

The battery charge and regulation circuitry 258 may be configured to electrically connect or disconnect the rectifier 252 and the battery bank 260. When the rectifier 252 and the battery bank 260 is electrically disconnected, electrical energy from the rectifier 252 may not be conducted to the battery bank 260 to charge the batteries of the battery bank 260. When the rectifier 252 and the battery bank 260 is electrically connected, electrical energy from the rectifier 252 may be conducted to the battery bank 260 to charge the batteries of the battery bank 260.

The battery charge and regulation circuitry 258 is connected in data communication with the controller 300. In some embodiments, the battery charge and regulation circuitry 258, in response to a control command from the controller 300, is configured to send a signal corresponding to the status of the battery charge and regulation circuitry 258 or the battery bank 260 to the controller 300. In some embodiments, the battery charge and regulation circuitry 258, in response to a control command from the controller 300, is configured to disconnect the rectifier 252 and the battery bank 260, or connect the rectifier 252 and the battery bank 260.

In some embodiments, the battery charge and regulation circuitry 258 is configured to generate signals that corresponds to the status of the battery charge and regulation circuitry 258 or the battery bank 260, such as the connection between the rectifier 252 and the battery bank 260, the amount of charge in the battery bank 260, whether the battery bank 260 is being charged, and the source from which the battery bank 260 is being charged.

As depicted in FIG. 6, the electronics mandrel assembly 250 comprises the battery bank 260. The battery bank 260 is electrically coupled to the battery charge and regulation circuitry 258 for receiving electrical energy if the battery charge and regulation circuitry 258 connects the rectifier 252 and the battery bank 260. In some examples, the batteries of the battery bank 260 is charged to 8.2 volts.

In some examples, the batteries of the battery bank 260 are rechargeable lithium-ion batteries.

In some examples, the batteries of the capacitor bank 256 may operate at a temperature of 90° C. or lower.

In some examples, the battery bank comprises 12 batteries, wherein the electronics mandrel assembly 250 comprising six pockets, each pocket having two batteries connected in series, and the pockets of batteries connected in parallel. In some examples, the battery bank comprises 8 batteries, wherein the electronics mandrel assembly 250 comprising four pockets, each pocket having two batteries connected in series, and the pockets of batteries connected in parallel.

In some embodiments, where the well monitor 200 comprises more than one energy storage device, the energy storage devices of the well monitor 200 is electrically coupled to each other, and a first energy storage device is configured to charge a second energy device. In some embodiments, the electronics mandrel assembly 250 comprises circuitry for regulating when the first energy storage device of the well monitor 200 is charged by the second energy storage device. As depicted in FIG. 6, the electronics mandrel assembly 250 comprises a battery to capacitor charge circuitry 262. The battery to capacitor charge circuitry 262 is electrically coupled to the battery bank 260 and the capacitor bank 256.

The battery to capacitor charge circuitry 262 may be configured to electrically connect or disconnect the battery bank 260 and the capacitor bank 256. When the battery bank 260 and the capacitor bank 256 is electrically disconnected, electrical energy from the battery bank 260 may not be conducted to the capacitor bank 256 to charge the capacitors of the capacitor bank 256. When the battery bank 260 and the capacitor bank 256 is electrically connected, electrical energy from the battery bank 260 may be conducted to the capacitor bank 256 to charge the capacitors of the capacitor bank 256.

The battery to capacitor charge circuitry 262 is connected in data communication with the controller 300. In some embodiments, the battery to capacitor charge circuitry 262, in response to a control command from the controller 300, is configured to send a signal corresponding to the status of the battery to capacitor charge circuitry 262, the capacitor bank 256, or the battery bank 260 to the controller 300. In some embodiments, the battery to capacitor charge circuitry 262, in response to a control command from the controller 300, is configured to disconnect the battery bank 260 and the capacitor bank 256, or connect the battery bank 260 and the capacitor bank 256.

In some embodiments, the battery to capacitor charge circuitry 262 is configured to generate signals that corresponds to the status of the battery to capacitor charge circuitry 262, the capacitor bank 256, or the battery bank 260, such as the connection between the battery bank 260 and the capacitor bank 256, the amount of charge in the capacitor bank 256 and the battery bank 260, whether the capacitor bank 256 or the battery bank 260 is being charged, and the source from which the capacitor bank 256 or the battery bank 260 is being charged.

As depicted in FIG. 6, the electronics mandrel assembly 250 comprises the capacitor bank 256 and the battery bank 260. When the battery to capacitor charge circuitry 262 is connecting the capacitor bank 256 and the battery bank 260, electrical energy may flow from the batteries of the battery bank 260 to the capacitors of the capacitor bank 256, and the batteries of the battery bank 260 sufficiently charge the capacitors of the capacitor bank 256.

In some examples, the batteries of the battery bank 260 are sufficiently charged to provide sufficient electrical energy to the capacitors of the capacitor bank 256 for the well monitor 200 to operate for about 30 days without electrical energy generation by the electrical generator assembly 210.

The one or more energy storage devices of the well monitor 200 is electrically coupled to the vibration transducer 400, and the vibration transducer 400 may be selectively powered by applying a sufficient voltage to the vibration transducer 400 with the electrical energy stored in the one or more energy storage devices.

The controller 300 selectively causes the capacitors of the capacitor bank 256 to discharge, providing an output of a sufficient voltage to the vibration transducer 400. In some embodiments, the electrical power conducted from the capacitor bank 256 to the vibration transducer 400 is DC power.

The electronics mandrel assembly 250 comprises circuitry for controlling when the energy storage device of the well monitor 200 applies a sufficient voltage to the vibration transducer 400 for the vibration transducer 400 to generate a signal. As depicted in FIG. 6, the electronics mandrel assembly 250 comprises a vibration transducer drive circuitry 264 for controlling when a sufficient voltage is applied to the vibration transducer 400 for the vibration transducer 400 to generate a signal. The electrical energy for applying the sufficient voltage to the vibration transducer 400 is stored in the capacitor bank 256. The vibration transducer drive circuitry 264 is electrically coupled to the capacitor bank 256 and the vibration transducer 400.

The vibration transducer drive circuitry 264 may be configured to electrically connect or disconnect the capacitor bank 256 and the vibration transducer 400. When the capacitor bank 256 and the vibration transducer 400 is electrically disconnected, electrical energy from the capacitor bank 256 may not be conducted to the vibration transducer 400 to apply a sufficient voltage to the vibration transducer 400 for the vibration transducer 400 to generate a signal. When the capacitor bank 256 and the vibration transducer 400 is electrically connected, electrical energy from the capacitor bank 256 may be conducted to the vibration transducer 400 to apply a sufficient voltage to the vibration transducer 400 for the vibration transducer 400 to generate a signal.

The vibration transducer drive circuitry 264 is connected in data communication with the controller 300. In some embodiments, the vibration transducer drive circuitry 264, in response to a control command from the controller 300, is configured to send a signal corresponding to the status of the vibration transducer drive circuitry 264, the capacitor bank 256 or the vibration transducer 400 to the controller 300. In some embodiments, the vibration transducer drive circuitry 264, in response to a control command from the controller 300, is configured to disconnect the capacitor bank 256 and the vibration transducer 400, or connect the capacitor bank 256 and the vibration transducer 400.

In some embodiments, the vibration transducer drive circuitry 264 may be configured to generate signals that correspond to the status of the vibration transducer drive circuitry 264, or the vibration transducer 400, such as the connection between the capacitor bank 256 and the vibration transducer 400.

As depicted in FIG. 6, the capacitor bank 256 is electrically coupled to the vibration transducer 400. The capacitors of the capacitor bank 256 may be able to discharge more quickly than the batteries of the battery bank 260. The capacitors of the capacitor bank 256 may be able to provide a power surge to apply a sufficient voltage to the vibration transducer 400 for the vibration transducer 400 to generate a signal. In the configuration as depicted in FIG. 6, the batteries of the battery bank 260 maintain the capacitors of the capacitor bank 256 in a charged state when the electric generator assembly 210 is not generating electrical energy or if more electrical energy is required, and the capacitors of the capacitor bank 256 apply a sufficient voltage to the vibration transducer 400 for the vibration transducer 400 to generate a signal. In some embodiments, one or more than one of the energy storage devices of the well monitor 200 may be electrically coupled to the vibration transducer 400, where the one or more than one of the energy storage devices may apply a sufficient voltage to the vibration transducer 400 for the vibration transducer 400 to generate a signal.

In some embodiments, the vibration transducer drive circuitry 264 comprises an H-bridge circuit operated by the controller 300. Prior to charging the vibration transducer 400, the electrical energy stored in the capacitor bank 256 may be conducted through the H-bridge circuit, such that the voltage applied to the vibration transducer 400 may be applied in an alternating direction. The H-bridge circuit alternates the polarity of the DC voltage from the capacitors, such that the alternating polarity of the voltage has a particular frequency, where a wave having the frequency may traverse through the tubing 114. In some examples, the frequency is approximately 625 Hz.

A sufficiently high voltage may need to be applied to the vibration transducer 400 in order for the vibration transducer 400 to generate a signal. The charge carried by the one or more energy storage devices of the well monitor 200 may not be high enough to apply a sufficient voltage to the vibration transducer 400 for the vibration transducer 400 to generate a signal. Further, the one or more energy storage devices of the well monitor 200 may be unable to carry a charge sufficient for the vibration transducer 400 to generate a signal, for example, because it may not be feasible for the one or more energy storage devices to carry such a charge, or it may not be safe for the one or more energy storage devices to carry such a charge.

In some embodiments, the electronics mandrel assembly 250 comprises a step-up transformer 266 interposed between and electrically coupled to the vibration transducer drive circuitry 264 and the vibration transducer 400. The step-up transformer 266 is for increasing the voltage applied to the vibration transducer 400. The charge from the capacitor bank 256 may be raised to a sufficient voltage by the step-up transformer 266. In some examples, the step-up transformer 266 may raise the voltage charge of the capacitor bank 256 from 8 volts to 1000 volts peak to peak.

In some embodiments, the electronics mandrel assembly 250 comprises the controller 300. As depicted in FIG. 6, the controller 300 is connected in data communication with the capacitor charge and regulation circuitry 254, the battery charge and regulation circuitry 258, the battery to capacitor charge circuitry 262, and the vibration transducer drive circuitry 264. Further, the controller 300 may be in data communication with sensors 302 and an external memory 304.

The sensors 302 may be mounted to the electronics mandrel assembly 250. One or more sensors 302 may be received in a through hole 306 in the electronics mandrel assembly 250, such that the one or more sensors 302 are exposed to fluid in the annular passage 132. Other sensors 302 may be exposed to fluid flowing through the tubing 114 or the fluid conducted through the well monitor 200.

Figure 7:
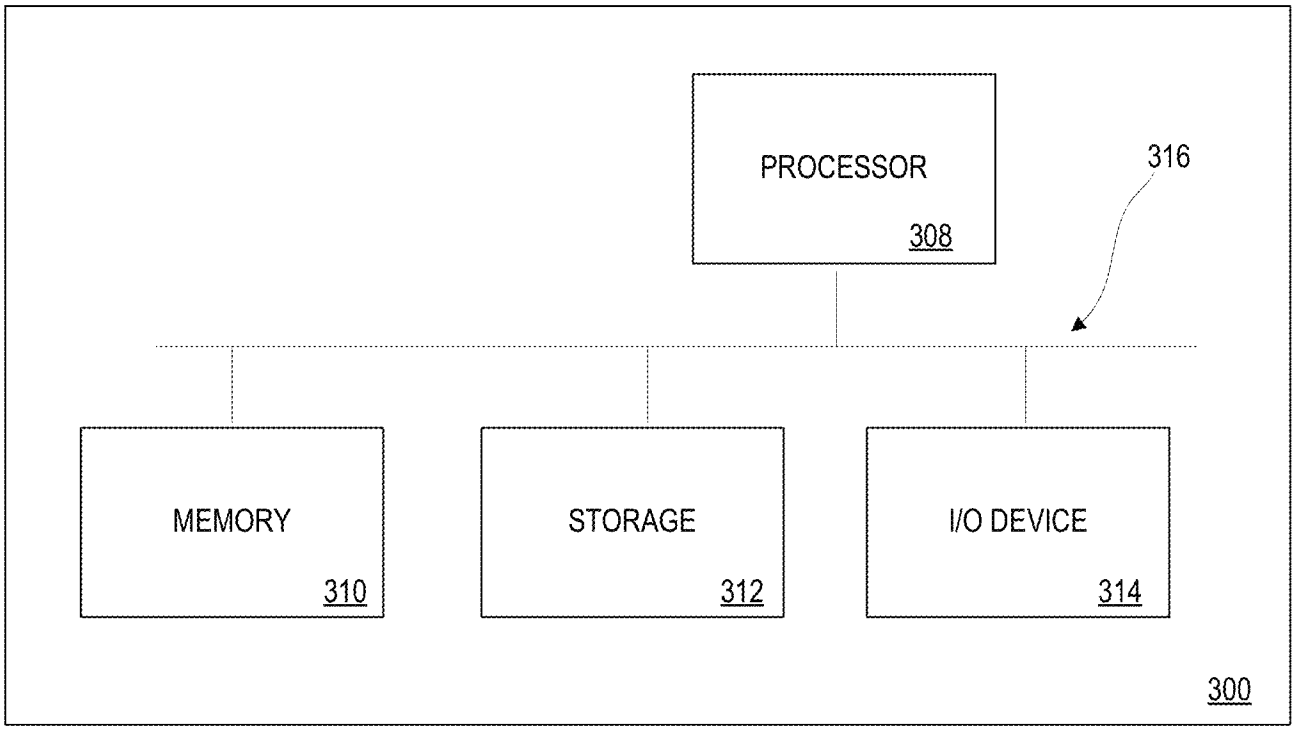
FIG. 7 is a block diagram of example components of a controller of the electronics mandrel assembly of FIG. 6.

FIG. 7 is a block diagram of example components of the controller 300. The components shown in FIG. 7 may be part of one or more semiconductor chips. As shown, the controller 300 comprises a processor 308, which may be a microprocessor, a memory 310, a storage 312, and one or more input/output (I/O) devices 314. The components may communicate with one another, e.g. by way of a bus 316. In the depicted embodiment, the input/output devices 314 include the sensors 302.

The sensors 302 may include sensors of multiple types for detecting well conditions of the wellbore 104. For example, the sensors 302 includes acoustic sensors such as microphones, sensors capable of detecting seismic vibrations, ultrasound sensors, electromagnetic sensors, pressure sensors for the annular passage 132 of the wellbore 104, pressure sensors for the discharge of the pump 118, temperature sensors, sensors for monitoring the speed or position of the rod 116 or the rod string 117, sensors for monitoring pump vibration, sensors for monitoring the position of the pump 118 or components of the pump 118 (e.g. the position of the rotor of the pump 118), or a combination thereof. The sensors 302, upon detection of the well condition, may convert the detected well condition into a signal. In some embodiments, the sensors 302, in response to a control command from the controller 300, is configured to send the signal indicative to the well condition to the controller 300.

The input/output devices 314 enable the controller 300 to interconnect with one or more devices. In some embodiments, the input/output devices 314 has inputs for the sensors of the well monitor 200, and the input/output devices 314 has outputs for all charge circuitry and is configured to drive diagnostic connection to a computer during testing of the well monitor 200. Further, the input/output devices 314 enables the controller 300 to interconnect with the circuitries of the electronics mandrel assembly 250, such as the capacitor charge and regulation circuitry 254, the battery charge and regulation circuitry 258, the battery to capacitor charge circuitry 262, and the vibration transducer drive circuitry 264.

As depicted in FIG. 6 and FIG. 7, the controller 300 comprises an internal memory 310 and is in data communication with an external memory 304. In some embodiments, the controller 300 comprises one or both of internal memory 310 and external memory 304

Figure 8:
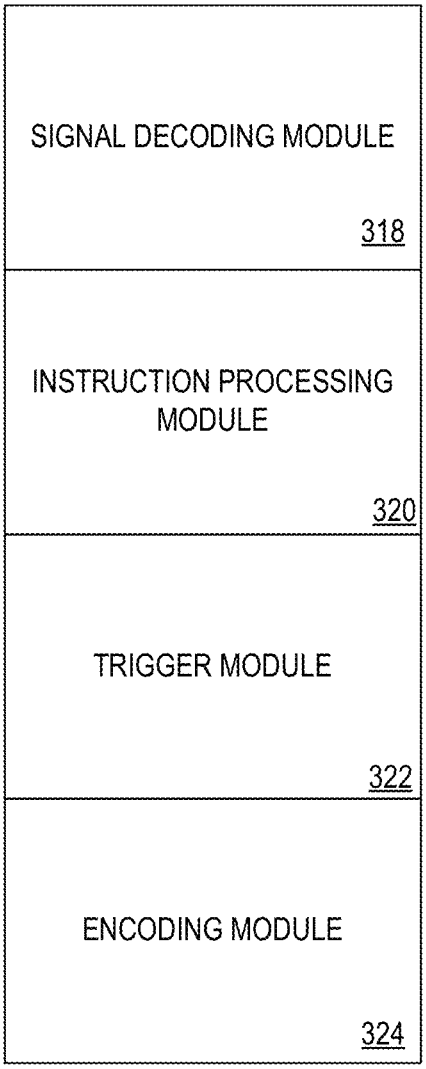
FIG. 8 is a block diagram of logic modules of the controller of FIG. 7.

FIG. 8 is a block diagram of logic modules of the controller 300. The logic modules may be implemented in any suitable combination of hardware and software. For example, the logic modules may be implemented in software stored in the storage 312 for execution by the processor 308. Alternatively, one or more logic modules may be implemented in specialized hardware circuits on one or more semiconductor chips.

As depicted in FIG. 8, the controller 300 comprises a signal decoder module 318, an instruction processing module 320, and a trigger module 322. The signal decoder module 318 converts signals received by the controller 300, such as signals generated by the capacitor charge and regulation circuitry 254, the battery charge and regulation circuitry 258, the battery to capacitor charge circuitry 262, the vibration transducer drive circuitry 264, and the sensors 302, into instructions readable by the instruction processing module 320. The decoding algorithm used by the signal decoding module 318 may be stored in the internal memory 310, external memory 304, or a combination thereof.

With respect to the signals received by the controller 300 from the circuitries of the electronics mandrel assembly 250, in some embodiments, the instruction processing module 320 parses the instructions and determines the flow of the electrical energy generated by the electrical generator assembly 210 to the power components of the electronics mandrel assembly 250 and to the vibration transducer 400. Based on the determination of the instruction processing module 320, the trigger module 322 causes the controller 300 to output a signal to the appropriate circuitry for controlling the flow of the electrical energy generated by the electrical generator assembly 210.

In some embodiments, the controller 300 receives a signal from the sensors 302 corresponding to a well condition of the wellbore 104. The signal decoding module 318 decodes the signal from the sensors 302, and the instruction processing module 320 determines that the decoded signal is a signal indicative of a well condition of the wellbore 104 to be communicated to the surface receiver 140. In some embodiments, the signal decoding module 318 decodes the signal from the sensors 302 into a string of binary data. In some embodiments, the controller 300 comprises an encoding module 324 that encodes the decoded signal received from the sensors 302. Based on the signal encoded by the encoding module 324, the trigger module 322 causes the controller 300 to output a signal to the vibration transducer drive circuitry 264 to selectively power the vibration transducer 400 to generate a signal indicative of the well condition. The controller 300 controls the connection between the one or more energy storage devices and the vibration transducer 400 via the vibration transducer drive circuitry 264. The controller 300 may cause the one or more energy storage devices to apply a sufficient voltage to the vibration transducer 400 for the vibration transducer 400 to generate a signal, indicative of the well condition, for communicating the well condition to the surface receiver 140. The signal generated by the vibration transducer 400 corresponds to the signal encoded by the encoding module 324 of the controller 300.

In some embodiments, the encoding module 324 of the controller 300 is programmed to encode the well condition signal using (N, M)-ary encoding, which encodes the well condition signal from the sensors 302 into a series of pulses to be triggered during particular time windows that are within particular time intervals. The timing (i.e. the particular window of the particular interval) for triggering the pulse corresponds to the signal that is being encoded using (N, M)-ary encoding. Based on the particular time windows within particular time intervals during which the pulses are triggered, the signal encoded by the encoding module 324 can be decoded, such that the decoded signal corresponds to the signal of the well condition as detected by the sensors 302.

(N, M)-ary encoding is a variation on M-ary encoding. M-ary encoding is the method of encoding an original string of binary data by dividing the original string of binary data into fixed packets, each packet comprising M bits, and identifying a moment in time to trigger a pulse to identify the data corresponding to each packet. When the time for triggering the pulses corresponding to each packet of data are considered together in a time sequence, the encoded signal may be decoded into the original string of binary data. Prior to encoding the original string of binary data, a controller may calculate the number of bits of the original string of binary data. If the number of bits of the original string of binary data is not a multiple of M, the controller may add a number of zeroes (0) to the original string of binary data such that the number of bits of the string of binary data is a multiple of M.

In (N, M)-ary encoding, the encoding module 324 of the controller 300 is configured to divide the original string of binary data into fixed packets of two sizes, N-bit-sized packets and M-bit-sized packets. When programmed to perform (N, M)-ary encoding, the encoding module 324 does not have to add a number of zeroes (0) to the original string of binary data such that the number of bits of the string of binary data has a certain number of bits that is a multiple of N or M. In some examples, the encoding module 324 is programmed to perform (2, 3)-ary encoding.

In some embodiments, when the encoding module 324 receives a string of binary data for encoding using (N, M)-ary encoding, such as binary data corresponding to a well condition sensed by the sensors 302, the encoding module 324 determines the number of bits of the string of binary data. Based on the number of bits in the string of binary data, the encoding module 324 will divide the string of binary data into N-bit-sized and M-bit-sized packets. For example, where the encoding module 324 is programmed to perform (2, 3)-ary encoding, the encoding module 324 will divide the string of binary data into 2-bit and 3-bit packets. The encoding module 324 will first determine how many 3-bit packets can be formed, and then, based on the number of remaining bits left over, the encoding module 324 will determine the number of 2-bit packets that can be formed. For example, if, after the encoding module 324 divides the string of binary data into 3-bit packets, there are two bits left, then there will be one 2-bit packet. As another example, if, after the encoding module 324 divides the string of binary data into 3-bit packets, there is one bit left, then the last three-bit packet is combined with the remaining one bit to form two 2-bit packets. As yet another example, if, after the encoding module 324 divides the string of binary data into 3-bit packets, there are no bits left, then no 2-bit packets will be formed.

For example, where the encoding module 324 of the controller 300 is programmed to perform (2, 3)-ary encoding, the encoding module 324 will divide a string of binary data comprising 9 bits into zero 2-bit packets and three 3-bit packets. As another example, a controller 300 programmed to perform (2, 3)-ary encoding will divide a string of binary data comprising 10 bits into two 2-bit packets and two 3-bit packets. As yet another example, a controller 300 programmed to perform (2, 3)-ary encoding will divide a string of binary data comprising 11 bits into one 2-bit packet and three 3-bit packets.

In some embodiments, the encoding module 324 programmed to perform (N, M)-ary encoding will add a parity bit to a string of binary data for checking the integrity of the data and correcting the data. The value of the parity bit may be initially unknown. In some embodiments, when the encoding module 324 adds a parity bit to the string of binary data, the number of bits of the string of binary data increases by one. In some embodiments, the parity bit is added at the end of the string of binary data, such that the parity bit is the least significant bit.

For example, a string of binary data that comprises 9 bits ([b8 b7 b6 b5 b4 b3 b2 b1 b0]) may be received by the encoding module 324 programmed to perform (N, M)-ary encoding. After the parity bit P is added to the string of binary data, the string of binary data comprises 10 bits ([b8 b7 b6 b5 b4 b3 b2 b1 b0 P]). The encoding module 324 programmed to perform (2, 3)-ary encoding would divide the 10-bit binary string into two 2-bit packets and two 3-bit packets ([b8 b7] [b6 b5] [b4 b3 b2] [b1 b0 P]).

In some embodiments, the value of the parity bit is determined by performing an exclusive-or logical operation (XOR) on the least significant bit of each divided packet, except for the packet containing the parity bit. For example, when considering the packets [b8 b7], [b6 b5], [b4 b3 b2], and [b1 b0 P], the value of P=b7 XOR b5 XOR b2.

The encoding module 324 programmed to perform (N, M)-ary encoding may determine a particular time window within a time interval during which to trigger a pulse to communicate the value of the N-bit-sized and M-bit-sized packets of data. Each window corresponds to a value of the packet of data. For example, each window corresponds to the decimal value of the packet of data, which may be a packet of binary data. Based on the particular time window of the time interval during which to trigger the pulse, the value of the packets of data is communicated.

The maximum length of the time interval, during which a pulse is to be triggered, is defined by a number of time windows, where each time window corresponds to an amount of time. The maximum length of the time interval, during which a pulse is triggered at a particular time window to communicate the value of the N-bit-sized and M-bit-sized packets of data, is a function of the number of bits in the N-bit-sized and M-bit-sized packets of data. For example, where the encoding module 324 is programmed to perform (N, M)-ary encoding for binary data, the maximum length of the time interval for communicating the N-bit-sized packet of data comprises $2^N$ time windows, and the maximum length of the time interval for communicating the M-bit-sized packet of data comprises $2^M$ time windows.

Figures 9A, 9B:
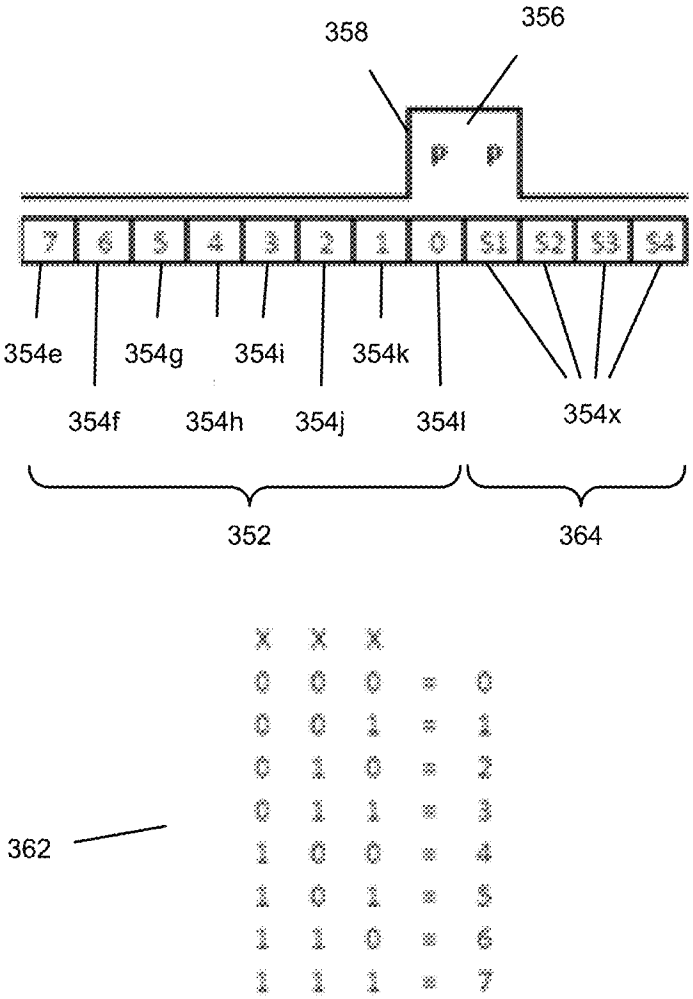
FIG. 9A is a schematic of an example encoding of a 2-bit packet of data using (2, 3)-ary encoding.
FIG. 9B is a schematic of an example encoding of a 3-bit packet of data using (2, 3)-ary encoding.

FIG. 9A is a schematic of an example encoding of a 2-bit packet of data using (2, 3)-ary encoding, and FIG. 9B is a schematic of an example encoding of a 3-bit packet of data using (2, 3)-ary encoding.

As depicted in FIG. 9A, a time interval 350 comprises four time windows 354*a*, 354*b*, 354*c*, and 354*d* ($2^2$). The time interval 350 comprising four time windows 354 is the maximum length of the time interval 350 for encoding a packet of binary data comprising two bits. As depicted in FIG. 9B, a time interval 352 comprise eight time windows 354*e*, 354*f*, 354*g*, 354*h*, 354*i*, 354*j*, 354*k*, and 354*l* ($2^3$). The time interval 352 comprising eight time windows 354 is the maximum length of the time interval 352 for encoding a packet of binary data comprising three bits. The encoding module 324, having converted the original string of binary data into N-bit-sized and M-bit-sized packets of data, knows how many of each packet of data the original string of binary data comprises.

To communicate the value of the N-bit sized or M-bit-sized packet of data, the encoding module 324 determines a particular time window within a time interval during which a pulse should be triggered. The pulse is triggered during the particular time window 354 that corresponds to the value of the packet of data. Each time window 354 corresponds to a value. For example, as depicted in FIG. 9A, the time window 354*a* corresponds to a decimal value of 3, the time window 354*b* corresponds to a decimal value of 2, the time window 354*c* corresponds to a decimal value of 1, and the time window 354*d* corresponds to a decimal value of 0. Similarly, as depicted in FIG. 9B, the time window 354*e* corresponds to a decimal value of 7, the time window 354*f* corresponds to a decimal value of 6, the time window 354*g* corresponds to a decimal value of 5, the time window 354*h* corresponds to a decimal value of 4, the time window 354*i* corresponds to a decimal value of 3, the time window 354*j* corresponds to a decimal value of 2, the time window 354*k* corresponds to a decimal value of 1, and the time window 354*l* corresponds to a decimal value of 0.

As depicted in FIG. 9A, to communicate the value of a 2-bit-sized packet of binary data, which can have a decimal value from 0 to 3, a pulse 356 may be triggered during any one of 4 time windows 354*a*, 354*b*, 354*c*, and 354*d*, with a pulse edge 358 of the pulse 356 rising at the beginning of any one of the 4 time windows 354*a*, 354*b*, 354*c*, and 354*d*. For example, as depicted in FIG. 9A, to communicate that the 2-bit-sized packet of data has a decimal value of 0, corresponding to the binary of 00, as depicted in a binary-to-decimal conversion table 360, the encoding module 324 determines that a pulse 356 should trigger during the time window 354*d*, with the pulse edge 358 of the pulse 356 rising at the beginning of the time window 354*d*. The length of the time interval 350 is the maximum length of the time interval 350, which is four time windows 354. As another example, to communicate that the 2-bit-sized packet of data has a decimal value of 2, corresponding to the binary number of 10, as depicted in the binary-to-decimal conversion table 360, the encoding module 324 determines that the pulse 356 should trigger during the time window 354*b*, with the pulse edge 358 of the pulse 356 rising at the beginning of the time window 354*b*. The length of the time interval 350 would be two time windows 354.

As depicted in FIG. 9B, to communicate the value of a 3-bit-sized packet of binary data, which can have a decimal value from 0 to 7, the pulse 356 may be triggered during any one of 8 time windows 354*e*, 354*f*, 354*g*, 354*h*, 354*i*, 354*j*, 354*k*, and 354*l*, with the pulse edge 358 of the pulse 356 rising at the beginning of any one of the 8 time windows 354*e*, 354*f*, 354*g*, 354*h*, 354*i*, 354*j*, 354*k*, and 354*l*. For example, as depicted in FIG. 9B, to communicate that the 3-bit-sized packet of data has the value of 0, corresponding to the binary of 000, as depicted in a binary-to-decimal conversion table 362, the encoding module 324 determines that the pulse 356 should trigger during the time window 354*l*, with the pulse edge 358 of the pulse 356 rising at the beginning of the time window 354*l*. The length of the time interval 352 is the maximum length of the time interval 352, which is eight time windows 354. As another example, to communicate that the 3-bit-sized packet of data has the value of 5, corresponding to the binary number of 101, as depicted in the binary-to-decimal conversion table 362, the encoding module 324 determines that the pulse 356 should trigger during the time window 354*g*, with the pulse edge 358 of the pulse 356 rising at the beginning of the time window 354*g*. The length of the time interval 352 would be three time windows 354.

After the encoding module 324 determines the particular time window 354 during which the pulse 356 should be triggered, the encoding module 324 is configured to determine that no any pulses 356 are to be triggered during a synchronization time interval 364 comprising a number of time windows to separate communication of a first packet of data from a second packet of data. In some examples, as shown in FIG. 9A and FIG. 9B, the synchronization time interval 364 comprises four time windows 354*x*.

In some examples, the amount of time corresponding to each time window 354 is approximately 100 mS, or 0.1 seconds. In some examples, the amount of time corresponding to each time window 354 is approximately 125 mS, or 0.125 seconds.

Figure 10:
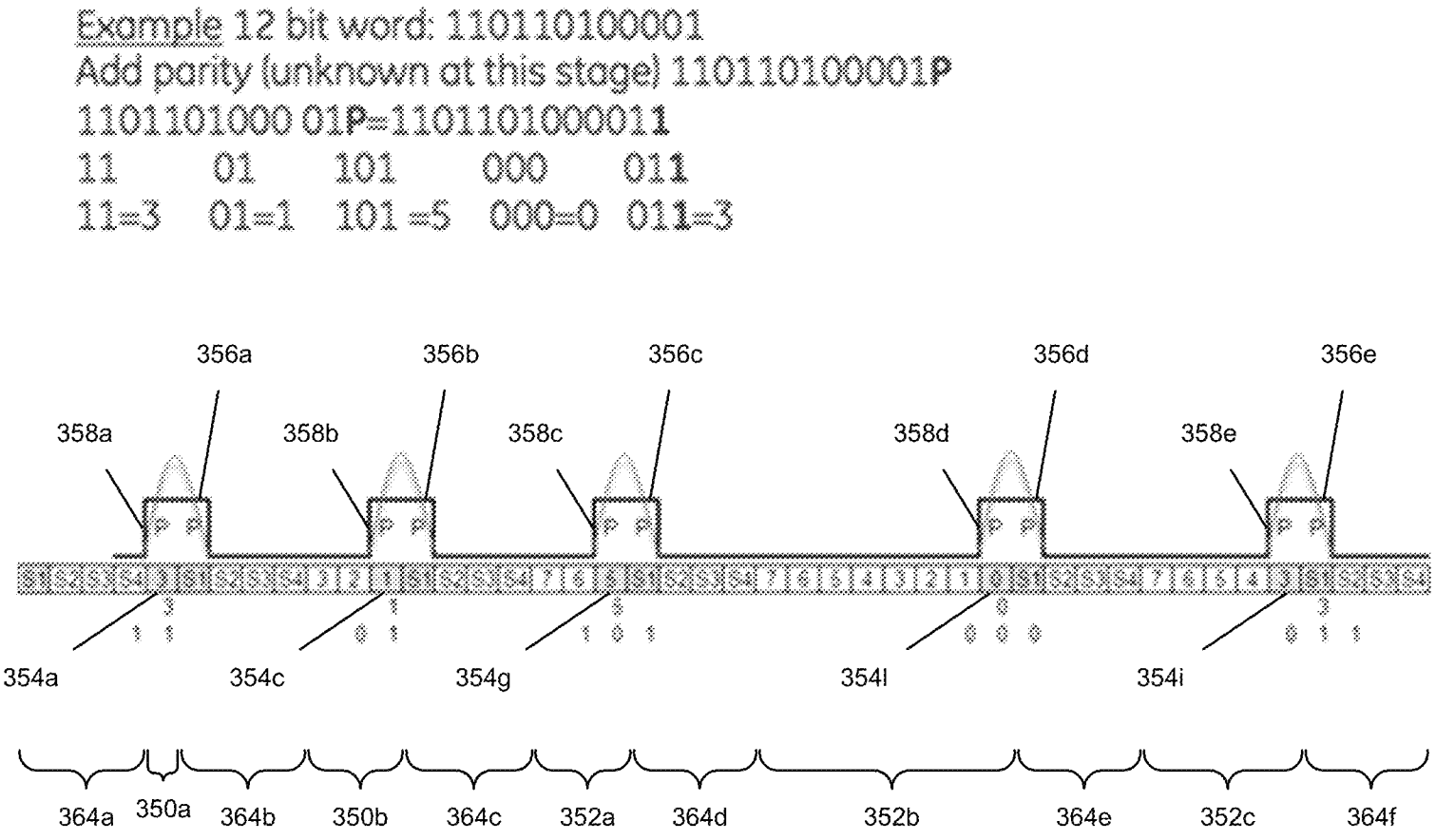
FIG. 10 is a schematic of an example encoding of a 12-bit string of binary data using (2, 3)-ary encoding.

FIG. 10 is a schematic of an example encoding of a 12-bit string of binary data using (2, 3)-ary encoding. As depicted in FIG. 10, the example string of binary data is

[110110100001]. This string of binary data may be decoded by the signal decoding module 318 from a signal that corresponds to a well condition of the wellbore 104 that is detected by the sensors 302. The signal decoding module 318 of the controller 300 may decode the signal from the sensors 302 into the string of binary data. The encoding module 324 is configured to add a parity bit P to the 12-bit string of binary data, such that there are now 13 bits in the string. The encoding module 324 is configured to divide the 13-bit string of binary data into 2-bit-sized and 3-bit-sized packets of data. As depicted in FIG. 10, the 13-bit string of binary data is divided into two 2-bit-sized packets of data ([11], [01]) and three 3-bit-sized packets of data ([101], [000], [01P]). The encoding module 324 is configured to determine the value of the parity bit P by performing an exclusive-or logical operation (XOR) on the least significant bit of each divided packet, except for the packet containing the parity bit. As depicted in FIG. 10, the least significant bit of each divided packet is 1, 1, 1, and 0, such that the value of P=1 XOR 1 XOR 1 XOR 0=1. With the parity bit calculated, the encoding module 324 has processed the original 12-bit string of binary data into five packets of data ([11], [01], [101], [000], [011]).

The encoding module 324 is configured to calculate the decimal value of each packet of data, which a packet of binary data. For example, as depicted in FIG. 10, packet [11] has a decimal value of 3, packet [01] has a decimal value of 1, packet [101] has a decimal value of 5, packet [000] has a decimal value of 0, and packet [011] has a decimal value of 3.

For a packet of data, as depicted in FIG. 10, the encoding module 324 is configured to determine a particular time window 354 corresponding to the decimal value of the packet of data during which the pulse 356 should be triggered. Then, the encoding module 324 is configured to wait until after the synchronization time interval 364 before determining a particular time window 354 corresponding to the decimal value of the packet of data during which the pulse 356 should be triggered for the next packet of data.

For packet [11], a 2-bit packet of binary data, the encoding module 324 is configured to wait until the completion of a synchronization time interval 364*a*, and then determine that a pulse 356*a* should be triggered within a time interval 350*a*, with a pulse edge 358*a* of the pulse 356*a* rising at the beginning of the time window 354*a*, and then the encoding module 324 waits until the completion of a synchronization time interval 364*b*.

For packet [01], a 2-bit packet of binary data, the encoding module 324 is configured to wait until the completion of the synchronization time interval 364*b*, and then determine that a pulse 356*b* should be triggered within a time interval 350*b*, with a pulse edge 358*b* of the pulse 356*b* rising at the beginning of the time window 354*c*, and then the encoding module 324 waits until the completion of a synchronization time interval 364*c*.

For packet [101], a 3-bit packet of binary data, the encoding module 324 is configured to wait until the completion of the synchronization time interval 364*c*, and then determine that a pulse 356*c* should be triggered within a time interval 352*a*, with a pulse edge 358*c* of the pulse 356*c* rising at the beginning of the time window 354*g*, and then the encoding module 324 waits until the completion of a synchronization time interval 364*d*.

For packet [000], a 3-bit packet of binary data, the encoding module 324 is configured to wait until the completion of the synchronization time interval 364*d*, and then determine that a pulse 356*d* should be triggered within a time interval 352*b*, with a pulse edge 358*d* of the pulse 356*d* rising at the beginning of the time window 354*l*, and then the encoding module 324 waits until the completion of a synchronization time interval 364*e*.

For packet [011], a 3-bit packet of binary data, the encoding module 324 is configured to wait until the completion of the synchronization time interval 364*e*, and then determine that a pulse 356*e* should be triggered within a time interval 352*c*, with a pulse edge 358*e* of the pulse 356*e* rising at the beginning of the time window 354*i*, and then the encoding module 324 waits until the completion of a synchronization time interval 364*f*. The synchronization time interval 364*f* may separate the pulses corresponding to the 12-bit string of binary data is [110110100001] with another string of binary data.

As described herein, the encoding module 324 of the controller 300 is programmed to encode data, such as data corresponding to a well condition of the wellbore 104 detected by the sensors 302, using (N, M)-ary encoding. As described with respect to FIG. 10, when the encoding module 324 is programmed to encode the 12-bit string of binary data [110110100001] using (N, M)-ary encoding, the 12-bit string of binary data is [110110100001] can be encoded into particular time windows 354*a*, 354*c*, 354*g*, 354*l*, and 354*i* of particular time intervals 350*a*, 350*b*, 352*a*, 352*b*, and 352*c* during which five pulses 356*a*, 356*b*, 356*c*, 356*d*, and 356*e* should be triggered.

In some embodiments, the pulse may have a frequency corresponding to a passband frequency, where a wave having the frequency may traverse through the tubing 114 to the surface 10.

In some examples, a data sequence to be encoded by the encoding module 324 comprises 2 synchronization bits, 12 bits for the pressure of the casing 106 or the pressure of the annular passage 132, 12 bits for tubing 114 pressure or the pump discharge pressure, 8 bits for temperature, and status. In some examples, to encode and transmit this example data sequence every 30 minutes, approximately 0.1 watts is required to be continuously generated per hour by the electric generator assembly 210.

In some embodiments, the encoded data may be stored in the internal memory 310, external memory 304, or a combination thereof, and may be recalled by the controller 300 for sending signals to the vibration transducer drive circuitry 264 to control application of a sufficient voltage to the vibration transducer 400 by the capacitor bank 256.

The controller 300 may be programmed during assembly of the well monitor 200 or by updating its firmware at the surface 10, prior to insertion of the well monitor 200 in the wellbore 104. The data configuration of the controller 300 may also be programmed once the well monitor 200 is assembled at the surface 10. The data configuration outlines what data is to be sent, resolution, and encoding sequence. In some embodiments, the controller 300 may be programmed when the well monitor 200 is downhole. The data configuration may be downlinked via acoustic signals from the surface 10 down the tubing 114 and received by the well monitor 200.

In some embodiments, the power and controls components of the electronics mandrel assembly 250 may be mounted on a printed circuit board and fixed to the electronics mandrel assembly 250 within a recess or a compartment of the electronics mandrel assembly 250.

In some embodiments, the well monitor 200 comprises the vibration transducer 400 that is selectively powered to produce a signal indicative of a well condition of the wellbore 104. The vibration transducer 400 is in electrical communication with the vibration transducer drive circuitry 264. The vibration transducer 400 is in selective electrical communication with the capacitor bank 256 via the vibration transducer drive circuitry 264. The vibration transducer 400 is in electrical communication with the capacitor bank 256 when the vibration transducer drive circuitry 264 connects the capacitor bank 256 to the vibration transducer 400, which allows electrical energy to flow from the capacitor bank 256 to the vibration transducer 400. The vibration transducer 400 is not in electrical communication with the capacitor bank 256 when the vibration transducer drive circuitry 264 disconnects the capacitor bank 256 to the vibration transducer 400, which does not allow electrical energy to flow from the capacitor bank 256 to the vibration transducer 400.

The vibration transducer 400 is configured to generate a signal when a sufficient voltage is applied to the vibration transducer 400. The strength of the signal may be changed based on the amount of voltage that is applied to the vibration transducer 400. In some embodiments, as depicted in FIG. 6, the step-up transformer 266 is interposed between the vibration transducer drive circuitry 264 and the vibration transducer 400 for sufficient voltage to be applied to the vibration transducer 400 such that the vibration transducer 400 can generate a signal with a desired signal strength. In some embodiments, the generated signal is an electromagnetic signal or a radio frequency signal.

In some embodiments, the vibration transducer 400 of the well monitor 200 is a piezoelectric transducer. As depicted in FIG. 2, FIG. 3, and FIG. 4A, the piezoelectric transducer and the tubing 114 are generally aligned along a common axis extending through the center of the piezoelectric transducer and the center of the well monitor 200. The piezoelectric transducer is positioned uphole of the electronics mandrel assembly 250.

Figure 11:
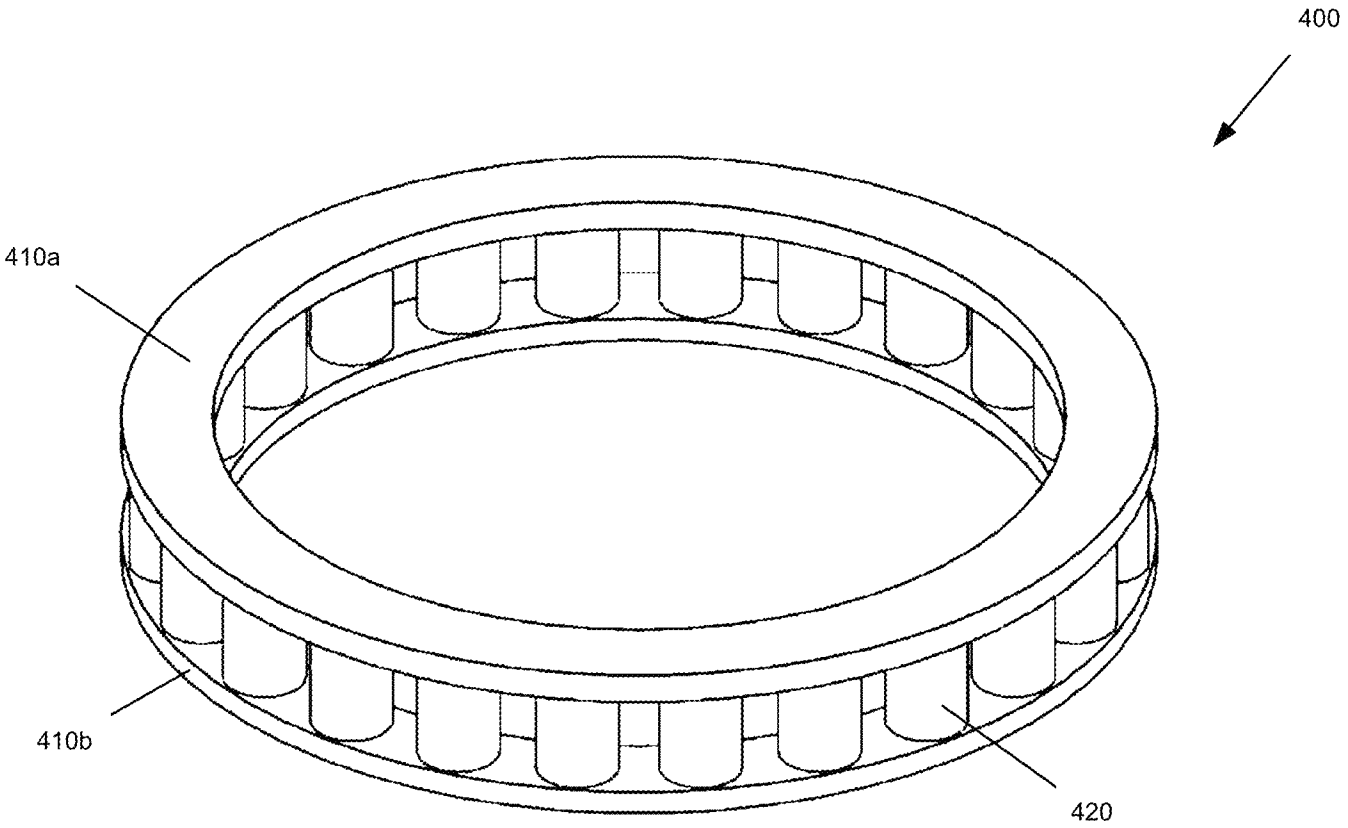
FIG. 11 is a perspective view of a vibration transducer of the well monitor of FIG. 2 as a piezoelectric transducer.

FIG. 11 is a perspective view of the vibration transducer 400 of the well monitor 200 as the piezoelectric transducer. In some embodiments, the piezoelectric transducer comprises two metal rings 410*a* and 410*b* and a plurality of piezo elements mounted therebetween. In some embodiments, the piezo elements are ceramic. In some embodiments, the piezo elements are piezo disks. The piezo elements are stacked as piezo stacks 420 and mounted to the rings 410*a* and 410*b*. The piezo elements are wired in parallel. As depicted in FIG. 11, the piezo stacks 420 are mounted around the rings 410*a* and 410*b*. The center of the piezoelectric transducer defines a channel to allow for coupling with the well monitor 200 and for receiving the rod string 117 through the well monitor 200. In some examples, the piezoelectric transducer comprises approximately 20 piezo elements in each stack 420. The number of stacks 420 of piezo elements may vary based on the size of the tubing 114, the size of each piezo element, and the number of stacks that may fit around the rings 410*a* and 410*b*. In some examples, where the tubing 114 has a 3.5" diameter, there are 36 stacks 420 of piezo elements that fit around the rings 410*a* and 410*b*, wherein each stack of piezo elements comprises 20 piezo elements.

Figure 4B:
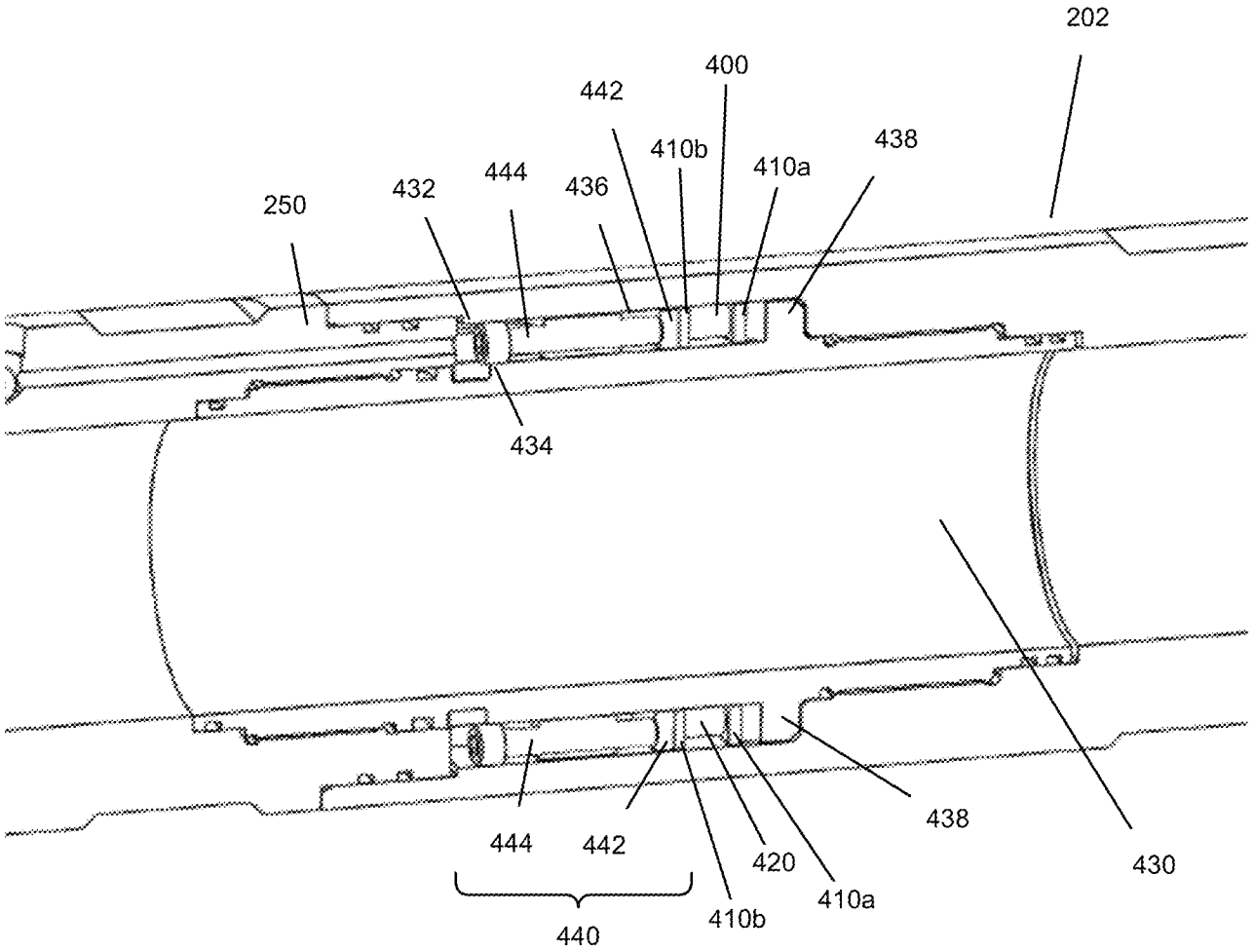
FIG. 4B is an enlarged view of the portion of the well monitor of FIG. 4A, the portion identified by window B shown in FIG. 4A.

In some embodiments, the well monitor 200 comprises a support mandrel 430 for supporting the piezoelectric transducer in the well monitor 200. The support mandrel 430 is received through the centers of the two metal rings 410*a* and 410*b* of the piezoelectric transducer. FIG. 4B is an enlarged view of the portion of the well monitor of FIG. 4A, the portion identified by window B shown in FIG. 4A, without the uphole centralizer 146. As depicted in FIG. 4B, the electronics mandrel assembly 250 and the uphole collar 202 enclose the support mandrel 430, with a downhole end of the support mandrel 430 configured to abut against the electronics mandrel assembly 250, and an uphole end of the support mandrel 430 configured to abut against the uphole collar 202. An inner surface 432 of the uphole collar 202 and an outer surface 434 of the support mandrel 430 together define a recess 436 therebetween. As depicted in FIG. 4B, the piezoelectric transducer is received in the recess 436, with the ring 410*a* positioned uphole relative to the ring 410*b*. In some embodiments, the ring 410*b* is positioned uphole relative to the ring 410*a*.

As depicted in FIG. 4B, the support mandrel 430 comprises a shoulder 438 that extends around the circumference of the support mandrel 430 and into the recess 436. The shoulder 438 is positioned uphole of the piezoelectric transducer, and is pressed against and faces the ring 410*a* of the piezoelectric transducer.

As depicted in FIG. 4B, the well monitor 200 comprises a mounting assembly 440 for pressing the piezoelectric transducer against the shoulder 438. A downhole end of the mounting assembly 440 is configured to abut against the electronics mandrel assembly 250. At an uphole end of the mounting assembly 440, the mounting assembly 440 comprises a loading plate 442. The mounting assembly 440 further comprises a cap screw 444 for adjusting the position of the loading plate 442. As depicted in FIG. 4B, the loading assembly 440 abuts against the electronics mandrel assembly 250, and the loading plate 442 has been positioned by adjusting the cap screw 444 to press against the ring 410*b*, such that the ring 410*a* is pressed against the shoulder 438 of the support mandrel 430.

When a sufficient voltage is applied to the piezo elements, each piezo element undergoes an axial displacement in response to the application of the sufficient voltage, such that the rings 410*a* and 410*b* of the piezoelectric transducer undergo an axial displacement. The ring 410*a* displaces axially in an uphole direction, and the ring 410*b* displaces axially in a downhole direction. When the ring 410*a* undergoes the axial displacement, the ring 410*a* displaces the shoulder 438 that is pressed against the ring 410*a*. This displacement of the ring 410*a* and the shoulder 438 generates a stress wave that traverses through the support mandrel 430, the uphole collar 202, and then through the tubing 114 to the surface 10. In some examples, the piezoelectric transducer may displace by approximately 0.15% of the height of the stack 420 of piezo elements when a sufficient voltage is applied to the piezoelectric transducer. In some examples, where the height of the stack 420 of piezo elements is approximately 0.375", the displacement may be approximately 0.15% of 0.375", which is approximately 0.056".

In some examples, the vibration transducer 400 has a thickness of approximately 0.4". In such examples, the stack 420 of 20 piezo elements has a height of approximately 0.375", and the thickness of the rings 410*a* and 410*b* are approximately 0.025".

In some examples, the surface area of the piezo elements, where the piezo elements are piezo ceramic disks, that are in contact with the rings 410*a* and 410*b*, is approximately 3.093 square inches. In some examples, the surface area of the piezo elements, where the piezo elements are solid piezo rings, that are in contact with the rings 410*a* and 410*b*, is approximately 3.97 square inches.

In some examples, the piezo elements are manufactured using PZT (lead zirconate titanate) piezoelectric material. In some examples, where the piezo element is the piezo ceramic disk, each disk is approximately 0.020" thick. A plurality of piezo ceramic disks may be stacked to form the piezo stack 420. In some examples, the diameter of each piezo ceramic disk is 0.375". In such examples, 32 stacks 420 may be mounted to the rings 410*a* and 410*b*. In other examples the diameter of each piezo ceramic disk is 0.314". In such examples, 36 stacks 420 may be mounted to the rings 410*a* and 410*b*. The diameter of the piezo ceramic disks and the number of stacks 420 that may be mounted to the rings 410*a* and 410*b* is selected based on how many stacks that may fit on the rings 410*a* and 410*b*. The energy transfer between the piezo ceramic disks may be improved as the surface area of the piezo elements that are in contact with the rings 410*a* and 410*b* increases.

In some examples, 50 W of electrical energy is applied to the vibration transducer 400.

In some examples, based on applying 50 W of electrical energy to the vibration transducer 400, 10-25 W of acoustical energy is generated for displacing the vibration transducer 400 and generating a stress wave that traverses through the tubing 114 to the surface 10.

In some examples, the estimated signal detection sensitivity is approximately 1 μW.

In some examples, where 10-25 W of acoustical energy is generated for displacing the vibration transducer 400, the attenuation capability is approximately 70-80 dB. 10 W of acoustical energy corresponds to approximately 70 dB ($10*LOG_{10}$ 10 W/1 μW)=70 dB). 25 W of acoustical energy corresponds to approximately 74 dB ($10*LOG_{10}$ 25 W/1 μW)=74 dB). In some examples, based on using a slow baud rate with a framing method and notch filter, there may be a 6-8 dB improvement during the decoding of the stress wave at the surface 10, so the attenuation capability of 25 W of acoustical energy may be approximately 80 dB.

In some examples, the electrical generator assembly 210 may generate sufficient electrical energy to sustain transmission of stress waves through the tubing 114 every 0.5 hours indefinitely. In such examples, each individual magnet 214 has strength of approximately 13,200 gauss, the magnets 214 are manufactured with Neodymium (NdFeB), and the distance between the outside flat face of the magnet 214 and the inner surface of the electric generator 212 is approximately 0.436". In such examples, the windings 216 have a 3 phase, 12 slot, 3 pole, constant pitch configuration, wherein each phase comprises 768 turns of 34 American wire gauge wire. In such examples, the electric generator assembly 210 generates approximately 8 volts when the rod string 117 rotates at 100 rotations per minute, and the electric generator assembly 210 generates approximately 40 volts when the rod string 117 rotates at 500 rotations per minute. Variances by changing the number of windings and capacitors may change the amount of data transmitted and the frequency of data transmission.

When the well monitor 200 is coupled to the tubing 114, the piezoelectric transducer is compressed. When a sufficiently high voltage is applied to the piezoelectric transducer, the signal generated by the piezoelectric transducer is the stress wave that overcomes the force compressing the piezoelectric transducer. The generated stress wave traverses the well monitor 200 and the tubing 114 to the surface 10. In some examples, when the well monitor 200 is coupled to the tubing 114 in the wellbore 104, the piezoelectric transducer is under 50,000 pounds of compression force. In some examples, the well monitor 200 is coupled to the tubing 114 and positioned downhole in the wellbore 104 that is approximately 2,830 to 6,000 feet below the surface 10.

When a sufficiently high voltage is applied to the piezoelectric transducer to power the piezoelectric transducer, the signal generated by the piezoelectric transducer has a frequency such that the signal traverses the well monitor 200 and the tubing 114, and pass through the joints of the tubing 114, to the surface 10. In some examples, the frequency of the generated signal is between approximately 600 Hz and 650 Hz. In some examples, the frequency of the generated signal is approximately 625 Hz. In some examples, the frequency of the generated signal is between approximately 925 Hz and 975 Hz. In some examples, the frequency of the generated signal is between approximately 1175 Hz and 1225 Hz.

The surface receiver 140 is configured to receive the signals generated by the vibration transducer 400. The surface receiver 140 may comprise an intrinsically safe accelerometer. In some embodiments, the surface receiver comprises a piezo element that generates a signal, such as an electric charge, based on mechanical stress. Where the vibration transducer 400 is the piezoelectric transducer, the stress wave generated through the tubing 114 applies the mechanical stress on the piezo element of the surface transceiver 140 to generate a signal. As depicted in FIG. 1, the surface receiver 140 may be connected to the wellhead 112. In some embodiments, the surface receiver 140 is magnetically mounted to the wellhead 112 to detect the vibration signal.

In some examples, the transmission time for the signal generated by the vibration transducer 400 to be received by the surface receiver 140 is approximately 15 seconds at approximately 18-26 baud rate, or approximately 20 baud rate.

The surface receiver 140 comprises a signal acquisition board for acquiring the signal, an amplifier to amplify the signal, a frequency filter to filter out signals outside of the frequency range of the signals generated by the vibration transducer 400, and an analog to digital converter to convert the detected signal into a digital signal. After the detected signal is converted into a digital signal, it is further processed by a matching filter to enhance the signal to noise ratio.

The surface receiver 140 may be in data communication via a communication link 142 with a supervisory control and data acquisition (SCADA) system, with an electronic device (not shown), such as a mobile device, a computer, personal digital assistant, laptop, tablet, smart phone, media player, electronic reading device, data communication device, and the like, or any combination thereof. The communication link 142, such as a modbus, may connect the surface receiver 140 to a plurality of SCADA systems or electronic devices. In some embodiments, the surface receiver 140 is a component of the SCADA systems or electronic device, or may comprise the SCADA systems or the electronic device.

In some embodiments, the surface receiver 140 comprises a decoding module and a processing module. The decoding module decodes the signal with a decoding algorithm generated from the vibration transducer 400. The decoding algorithm of the surface receiver 140 is based on the encoding algorithm used by the encoding module 324 of the controller to encode the signals indicative of the well condition of the wellbore 104. For example, where the encoding module 324 encodes the signals indicative of the well condition of the wellbore 104 using (2, 3)-ary encoding, the surface receiver 140 will decode the signals generated by the vibration transceiver 400 (which correspond to the signals encoded by the encoding module 324 that correspond to decoded signals of the sensors 302 indicative of a well condition of the wellbore 104) using a decoding algorithm that can decode signals that have been encoded using (2, 3)-ary encoding. In some embodiments, the decoding module further processes the decoded signal with a matched filter to improve the signal-to-noise ratio of the detected signal. The processing module processes the decoded signal and determines the well condition of the wellbore 104 detected by the sensors 302 of the well monitor 200. In some embodiments, the SCADA system or the electronic device in data communication with the surface receiver 140 via the communication link 142 comprises the decoding module and the processing module.

In some embodiments, the surface receiver 140 comprises a display controller and a display screen, such as a liquid crystal display screen. The display controller is configured to process the decoded signal of the well condition of the wellbore 104, generated by the vibration transducer 400 of the well monitor 200, and render visual representation of the well condition of the wellbore 104 on the display screen of the surface receiver 140. In some embodiments, the SCADA system or the electronic device in data communication with the surface receiver 140 via the communication link 142 comprises the display controller and the display screen.

In some embodiments, the processor module processes the signal corresponding to the annulus pressure of the wellbore 104 and determines the fluid level within the wellbore 104. Based on the determined fluid level within the wellbore 104, the efficiency of the production from the wellbore 104 can be improved.

In some embodiments, the surface receiver 140 is in data communication with the prime mover 124, and the processor of the surface receiver 140 comprises an optimization module, programmed with a pump control algorithm. The optimization module, using the pump control algorithm, can determine changes to the operating conditions of the wellbore 104 to improve the efficiency of producing fluids from the wellbore 104. For example, based on the determined fluid level in the wellbore 104, the optimization module may determine a speed of the prime mover 124 for efficiently maintaining the fluid level in the wellbore 104, or may determine a speed of the prime mover 124 for changing the fluid level in the wellbore 104 to improve the efficiency of producing fluids from the wellbore 104. In some embodiments, the optimization module may cause the processor of the surface receiver 140 to send a control command to the prime mover 124 to change the speed of the prime mover 124 to change the fluid level within the wellbore 104 for improving the efficiency of producing fluids from the wellbore 104. In some embodiments, the changes to the operating conditions of the wellbore 104 as determined by the optimization module may be displayed on the display screen by the display controller. In some embodiments, the SCADA system or the electronic device in data communication with the surface receiver 140 via the communication link 142 comprises the optimization module.

In some embodiments, the surface receiver 140 comprises an input device, such as a keyboard, a mouse, a touch screen, a panel of buttons, or a combination thereof, for receiving an input, such as from a user. In some embodiments, in response to the received input, the optimization module may cause the processor of the surface receiver 140 to send a control command to change the operating condition of the wellbore, such as sending the control command to the prime mover 124 to change the speed of the prime mover 124. For example, based on an input for the wellbore 104 to have a certain fluid level, the optimization module causes the controller to send a control command to the prime mover 124 or to a power source of the prime mover 124 to change the speed of the prime mover. As another example, based on an input, the processor of the surface receiver 140 may send a control command to the prime mover 124 to turn on or turn off the prime mover 124. In some embodiments, the SCADA system or the electronic device in data communication with the surface receiver 140 via the communication link 142 comprises the input device.

In some embodiments, the surface receiver 140 comprises a memory, such as for storing the decoded well condition, and algorithms that are used by the controller of the surface receiver 140. For example, the memory stores the decoding algorithm for decoding the signal that is generated by the vibration transducer 400. As another example, the memory stores the pump control algorithm used by the optimization module to determine changes to the operating conditions of the wellbore 104 to improve the efficiency of producing fluids from the wellbore 104.

In some embodiments, the surface receiver 140 may be protected from the environment or conditions at the surface 10 with an enclosure (e.g. temperature, precipitation), such that the surface receiver 140 is suitable for use in the field where well operations occur.

Figure 12:
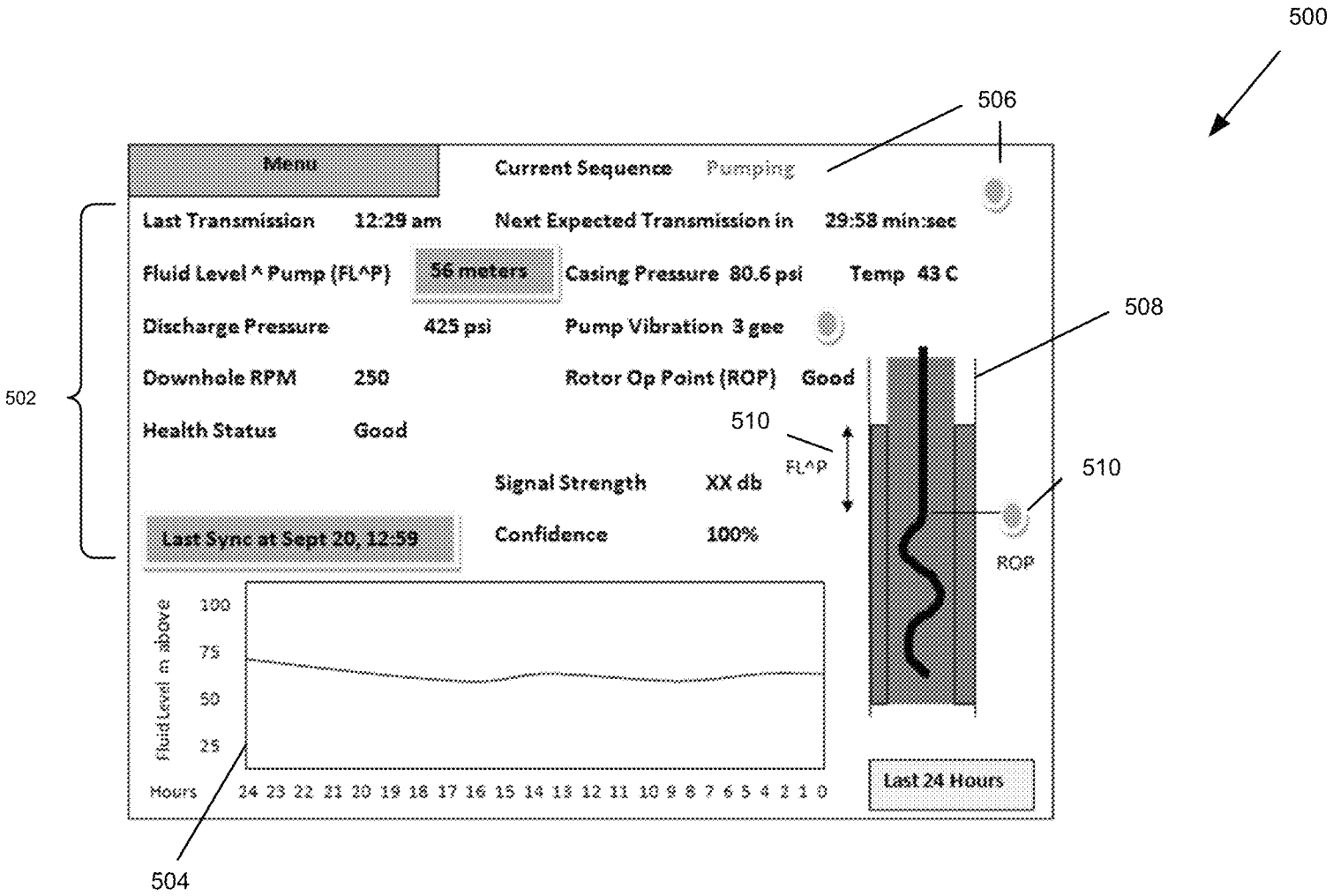
FIG. 12 is an example graphical user interface displaying data collected by the well monitor of FIG. 2.

FIG. 12 is an example graphical user interface 500 that may be rendered by the display controller of the surface receiver 140, the SCADA system, or an electronic device in data communication with the surface receiver 140. The display controller may render data 502 that has been decoded and processed from the signals generated by the vibration transducer 400. For example, as depicted in FIG. 12, the display controller may render data 502 relating to the time of last transmission, the time until the next expected transmission, fluid level in the wellbore 104, pressure in the casing 106, the temperature in the wellbore 104, the discharge pressure of the pump 118, the vibration of the pump 118, the downhole rotations per minute of the rod string 117, the position of the rotor or rotor operation point, the health status of the well monitor 200, the strength of the signal generated by the vibration transducer 400, the confidence level of the data that has been decoded and processed from the signals generated by the vibration transducer 400, and the last time synchronization occurred between the well monitor 200 and the surface receiver 140.

In some embodiments, the display controller may render a graphical representation of the data 502 that has been decoded and processed from the signals generated by the vibration transducer 400. For example, as depicted in FIG. 12, the display controller may render a graphical representation 504 of the data 502 corresponding to the fluid level above the pump for the last 24 hours. In some embodiments, different data 502 may be displayed as a graph. For example, based on an input from a user, other data 502, such as the pressure of the casing 106, may be represented as a graph.

In some embodiments, the display controller may render a status indicator 506 on the display screen, representing the status of the well monitor 200, such as indicating that the well monitor 200 is operational. For example, the status indicator 506 may indicate that the well monitor 200 is sensing that the pump 118 is pumping fluid through the tubing 116 up to the surface 10. As depicted in FIG. 12, the status indicator 506 may be a word that is representative of the well monitor 200 sensing that the pump 118 is pumping fluid, such as "Pumping". As another example, as depicted in FIG. 12, the display controller may render a colour or a flashing colour on the display screen, such as a coloured light (e.g. a green light) or a flashing light, indicating that the pump 118 is pumping fluid through the tubing 116 up to the surface 10. As yet another example, to indicate that the well monitor 200 is sensing that the pump 118 is not pumping fluid, the status indicator 506 may read "Not Pumping", or the coloured light may be a red light, or the flashing light will stop flashing.

In some embodiments, the display controller may be configured to operate in different states depending on data or signals received from the well monitor 200. For example, based on signals corresponding to the speed of the rod string 117 or electrical energy generated by the electric generator assembly 210, the display controller may determine that the electrical generator assembly 210 is operational or not and the operational state of the display controller may be adjusted accordingly.

In some embodiments, the display controller may render graphics on the display screen for assisting with understanding the meaning of the displayed data 502. For example, as depicted in FIG. 12, the display controller may render a graphic 508 that is representative the wellbore 104, the tubing 114, and the pump 118. Further, the display controller displays a legend 510 explaining the definition of the fluid level above the pump. Additional graphics may be rendered, such as a graphic 512, for assisting with understanding the meaning of the displayed data 502. For example, the display controller may render the graphic 512 indicating that the rotor operation point is good. The graphic 512 may be a colour (e.g. red, yellow, or green), which may correspond to whether the rotor operation point is good, needs review, or needs immediate correction.

In some embodiments, the vibration transducer 400 generates a signal that is directed towards the surface 10 to be received by the surface receiver 140. In some embodiments, where the vibration transducer 400 is the piezoelectric transducer, upon sufficient application of voltage, the vibration transducer 400 may generate two stress waves, one stress wave that traverses through the tubing 114 in an uphole direction, and a second stress wave that traverses through the tubing 114 in a downhole direction. The second stress wave traversing in the downhole direction, upon reaching the terminal end of the tubing 114, may reflect from the terminal end of the tubing 114 and traverse through the tubing 114 in the uphole direction. If the second stress wave, now traversing through the tubing 114 in the uphole direction, interacts with the first stress wave, this may cancel the first stress wave.

A passive reflector 700 may be interposed between the downhole end of the well monitor 200 and the tubing 114, such that the second stress wave that reflects from the bottom of the tubing 114 is in phase with the first stress wave, and combines constructively with the first stress wave that is traversing through the tubing 114 in the uphole direction. The passive reflector 700 may be manufactured using steel, composite material, or a combination thereof. In some embodiments, the passive reflector 700 may be an additional length of tubing, such that, as the stress wave generated by the piezoelectric transducer traverses downhole through the passive reflector 700, the stress wave shifts by a particular wavelength. The length of the passive reflector 700 is determined based on the location of the peak amplitude of the stress wave relative to its wavelength. In some embodiments, where the stress wave is a generally sinusoidal wave, the length of the passive reflector 700 corresponds to a quarter wavelength of the stress wave followed by one or more multiple half wavelengths of the stress wave. By interposing a passive reflector 700 having a length that corresponds to a quarter wavelength of the stress wave followed by one or more multiple half wavelengths of the stress wave, the second stress wave (the downhole-traversing stress wave) that is traversing in the downhole direction is shifted by a total of half wavelength of the stress wave, such that the second stress wave (the downhole-traversing stress wave), when reflected to traverse in the uphole direction, may combine constructively with the first stress wave that is traversing in the uphole direction.

The wavelength of a sound wave is the speed of the sound wave divided by its frequency. For example, the speed of an acoustic sound wave traversing through steel is 5130 m/s. If the acoustic sound wave has a frequency of 625 Hz, the wavelength of the sound wave is approximately 8 m (5130 m/s/625 Hz=8.208 m). By interposing a passive reflector 700 having a length of approximately 2 m downhole of the well monitor 200, the downhole-traversing stress wave will be shifted by approximately 4 m after it has reflected from the bottom of the tubing 114, and combine constructively with the stress wave originally traversing in the uphole direction.

In some embodiments, when the stress wave traverses downhole through the passive reflector 700, the energy of the stress wave dissipates entirely. In some embodiments, the energy of the stress wave dissipates entirely after the stress wave traverses downhole through the passive reflector 700, reflects from the terminal end of the tubing 114, and traverses uphole through the passive reflector 700. In some embodiments, the passive reflector 700 comprises notches for dissipating the energy of a stress wave that traverses through the passive reflector 700. In some examples, the passive reflector 700 may be 1 m to 4 m of tubing 114 interposed between the well monitor 200 and the pump 118, depending on the frequency of the stress wave.

In operation, the well monitor 200 as depicted in FIG. 2, FIG. 3, and FIG. 4A generates sufficient electrical energy to supply power to its power and control components and selectively power the vibration transducer 400 to produce a signal indicative of the well condition of the wellbore 104 as detected by the sensors 302 to communicate the detected well condition to the surface receiver 140. Cables from the surface 10 do not need to be run down into the wellbore 104 to supply electrical energy to the well monitor 200. The well monitor 200 is configured to operate with the pump 118, which may be a progressive cavity pump or a sucker rod pump. In some examples, the well monitor 200 is configured to operate where the wellbore 104 temperature is approximately 0 to 90° C., and the maximum wellbore 104 pressure is approximately 5,000 pounds per square inch.

The well monitor 200 is coupled to the tubing 114 of a well and is received in the wellbore 104. In some examples, the well monitor 200 is coupled to the tubing 114 and positioned downhole in the wellbore 104 that is approximately 2,830 to 6,000 feet below the surface 10. To begin production, the prime mover 124 drives the pump 118 by moving the rod string 117, such that the pump 118 conducts fluids in the tubing 114, such as fluid from the oil bearing formation 102, to the surface 10. The electrical generator assembly 210 generates electrical energy based on relative movement of the magnets 214 and the windings 216. As the rod 116 moves relative to the electric generator assembly 210, the magnets 214 move relative to the windings 216, which will generate an electromotive force in the electric circuits of the electric generator assembly 210 via electromagnetic induction. In some embodiments, the magnets 214 are mounted to the rod 116, and the windings 216 are mounted to the electrical generator assembly 210. As depicted in FIG. 1, where the pump 118 is a progressive cavity pump, the rod string 117 rotates relative to the well monitor 200. In some embodiments, where the pump 118 is a sucker rod pump, the rod string 117 reciprocates up and down relative to the well monitor 200. In some examples, the electric generator assembly 210 is configured to harvest magnetic flux ranging from 8 volts to 40 volts based on the rod 116 having 100 to 500 rotations per minute. In some examples, the electric generator assembly 210 generates 2.1 watts continuously (each of the three phases generates 0.7 watts continuously). In some embodiments, the current generated by the electric generator 212 of the electric generator assembly 210 is an alternating current. The electrical generator assembly 210 is electrically coupled to the electronics mandrel assembly 250 for storing the generated electrical energy.

The well monitor 200 stores the generated electrical energy in energy storage devices in the electronics mandrel assembly 250 as the electrical energy is being generated by the electric generator assembly 210. In some embodiments, the controller 300 is configured to control the flow of the electrical energy generated by the electrical generator assembly 210 to store the electrical energy using the one or more energy storage devices of the well monitor 200, such as the capacitor bank 256 and the battery bank 260.

The controller 300 periodically sends a control command to the capacitor charge and regulation circuitry 254, the battery charge and regulation circuitry 258, and the battery to capacitor charge circuitry 262 for the capacitor charge and regulation circuitry 254, the battery charge and regulation circuitry 258, and the battery to capacitor charge circuitry 262 to send a signal to the controller 300 corresponding to the status of the capacitor charge and regulation circuitry 254, the battery charge and regulation circuitry 258, the battery to capacitor charge circuitry 262, the capacitor bank 256, and the battery bank 260. The signal from the circuitries, capacitor bank 256, and the battery bank 260 may be a voltage provided by way of a wired connection. The signal decoding module 318 of the controller 300 converts the signals from the capacitor charge and regulation circuitry 254, the battery charge and regulation circuitry 258, the battery to capacitor charge circuitry 262, the capacitor bank 256, and the battery bank 260 into instructions readable by the instruction processing module 320, such that the controller 300 knows the statuses of the circuitries and the energy storage devices. Based on the statuses, the trigger module 322 causes the controller 300 to send another control command such that the capacitor charge and regulation circuitry 254, the battery charge and regulation circuitry 258, and the battery to capacitor charge circuitry 262 to connect or disconnect the rectifier 252, the capacitor bank 256, or the battery bank 260 for controlling the flow of the electrical energy generated by the electrical generator assembly 210 and for charging the capacitors in the capacitor bank 256 or the batteries in the battery bank 260. The control commands may be sent by the controller 300, for example, at a particular frequency, maintained, for example, by a clock signal.

For example, based on the signals sent by the circuitries of the electronics mandrel assembly 250, the controller 300 may detect that electrical energy is being generated by the electrical generator assembly 210 and flowing through the rectifier 252. The controller 300 may further detect that the capacitors of the capacitor bank 256 are insufficiently charged. The controller 300 may send a control command for the capacitor charge and regulation circuitry 254 to connect the rectifier 252 and the capacitor bank 256 such that the electrical energy may flow from the rectifier 252 to the capacitor bank 256 for charging the capacitors of the capacitor bank 256.

As another example, based on the signals sent by the circuitries of the electronics mandrel assembly 250, the controller 300 may detect that electrical energy is being generated by the electrical generator assembly 210 and flowing through the rectifier 252. The controller 300 may further detect that the capacitors of the capacitor bank 256 are sufficiently charged, but the batteries of the battery bank 260 are insufficiently charged. The controller 300 may send a control command to the capacitor charge and regulation circuitry 254 to disconnect the rectifier 252 and the capacitor bank 256, and may send a control command to the battery charge and regulation circuitry 258 to connect the rectifier 252 and the battery bank 260, such that the electrical energy may flow from the rectifier 252 to the battery bank 260 for charging the batteries of the battery bank 260.

As yet another example, based on the signals sent by the circuitries of the electronics mandrel assembly 250, the controller 300 may detect that electrical energy is not being generated by the electrical generator assembly 210, such as when the pump 118 or the prime mover 124 is shut down. The controller 300 may further detect that the capacitors of the capacitor bank 256 are insufficiently charged, but the batteries of the battery bank 260 are sufficiently charged. The controller 300 may send a control command for the battery to capacitor charge circuitry 262 to connect the battery bank 260 to the capacitor bank 256, such that the electrical energy may flow from the batteries of the battery bank 260 to the capacitors of the capacitor bank 256 for charging the capacitors of the capacitor bank 256. In some embodiments, the batteries of the battery bank 260 may charge the capacitors of the capacitor bank 256 to maintain a sufficient charge in the capacitor bank 256 for the well monitor 200 to generate and transmit well condition signals indicative of positioning of the pump, and the static pressure that is building up in the wellbore 104.

In some embodiments, the controller 300 is configured to selectively power the vibration transducer 400, to produce a signal indicative of a wellbore condition of the wellbore 104. A sufficient voltage may be applied to the vibration transducer 400 from the electrical energy stored in the energy storage devices of the well monitor 200.

The sensors 302 of the controller detect a well condition of the wellbore 104. The controller 300 may periodically receive signals from the sensors 302 corresponding to a wellbore condition of the wellbore 104 detected by the sensors 302. The signals from the sensors 302 may be obtained, for example, by polling the sensors 302 at a particular frequency, maintained, for example, by a clock signal. In some examples, the controller 300 polls the sensors 302 for a signal corresponding to a well condition every 30 minutes. Based on the signals received from the sensors 302, the signal decoder module 318 converts the signals, for example, into a string of binary data. As described herein, such as with respect to FIG. 9A, FIG. 9B, and FIG. 10, the encoding module 324 is configured to encode the string of binary data using (N, M)-ary encoding, such as (2, 3)-ary encoding. Having encoded the string of binary data into particular time windows of particular time intervals during which pulses should be triggered, the trigger module 322 may cause the controller 300 to send a control command to the vibration transducer drive circuitry 264 to connect the energy storage devices of the well monitor 200 to the vibration transducer 400, such that the energy storage devices of the well monitor 200 (e.g. the capacitor bank 256) applies a sufficient voltage to the vibration transducer 400 and powers the vibration transducer 400 to generate a signal. The signals generated by the vibration transducer 400 are generated at particular time windows within particular time intervals, and corresponds to the pulses that should be triggered during particular time windows that are within particular time intervals as determined by the encoding module 324.

In some embodiments, the control command from the controller 300 causes the vibration transducer drive circuitry 264 to connect the energy storage devices of the well monitor 200 (e.g. the capacitor bank 256) and the vibration transducer 400 when a signal is to be generated by the vibration transducer 400. When the vibration transducer drive circuitry 264 is connecting the capacitor bank 256 to the vibration transducer 400, the capacitors in the capacitor bank 256 are in electrical communication with the vibration transducer 400, such as the piezoelectric transducer, such that a sufficient voltage is applied to the vibration transducer 400 for the vibration transducer 400 generates a signal. In some embodiments, the control command from the controller 300 causes the vibration transducer drive circuitry 264 to disconnect the energy storage devices of the well monitor 200 (e.g. the capacitor bank 256) and the vibration transducer 400 when no signal is to be generated by the vibration transducer 400. When the vibration transducer drive circuitry 264 is not connecting the capacitor bank 256 and the vibration transducer 400, the capacitors in the capacitor bank 256 are not in electrical communication with the vibration transducer 400, such that the vibration transducer 400 does not generate a signal. In some embodiments, the controller 300, based on the control command that reflects the encoded signal from the encoding module 324, selectively connects the capacitor bank 256 and the vibration transducer 400, such that there is selective electrical communication between the capacitor bank 256 and the vibration transducer 400, via the vibration transducer drive circuitry 264. When the vibration transducer drive circuitry 264 is connecting and disconnecting the capacitor bank 256 and the vibration transducer 400, corresponding to the particular time windows within particular time intervals during which pulses should be triggered, as determined by the encoding module 324, a sufficient voltage is selectively applied to the vibration transducer 400 from electrical energy stored in the capacitor bank 256 to produce a signal particular time windows within particular time intervals that is indicative of the well condition of the wellbore 104 as detected by the sensors 302.

In some embodiments, the well monitor 200 is programmed to apply a sufficient voltage to the vibration transducer 400 generate a signal to be received by the surface receiver 140 periodically, and is maintained, for example, by a clock signal. In some examples, the well monitor 200 is programmed to apply a sufficient voltage to the vibration transducer 400 generate a signal to be received by the surface receiver 140 approximately every 30 minutes.

In some embodiments, where the vibration transducer 400 is the piezoelectric transducer, the vibration transducer 400 generates signals corresponding to the signal of the well condition as detected by the sensors 302 and as encoded by the encoding module 324, and the generated signals traverse through the well monitor 200 and the tubing 114 to the surface 10. The signals generated by the piezoelectric transducer may be stress waves. The signals generated by the vibration transducer 400 are received by the surface receiver 140.

When the signal generated by the vibration transducer 400 is received by the surface receiver 140, the signal is decoded and displayed on the display screen. In some embodiments, the surface 140 comprises the decoding module to decode the signal generated by the vibration transducer 400. In other embodiments, the signal is communicated via the communication link 142 to the SCADA system and or the electronic device for decoding and displaying on the display screen.

In some embodiments, based on the well condition of the wellbore 104, the efficiency of the production of fluids from the wellbore 104 can be improved. For example, the well monitor 200 can detect the pressure in the annular passage 132 via the sensors 302 and communicate the pressure in the annular passage 132 to the surface 10. In some embodiments, based on the pressure in the annular passage 132, the surface receiver 140, the SCADA system, or the electronic device is configured to calculate the annulus fluid level 138, and to control the speed of the prime mover 124 to improve the efficiency of conducting the fluids from the tubing 114 to the surface. In some embodiments, a user provides an input to the surface receiver 140, the SCADA system, or the electronic device for controlling the speed of the prime mover 124 for improving the efficiency of conducting the fluids from the tubing 114 to the surface.

Figure 13:
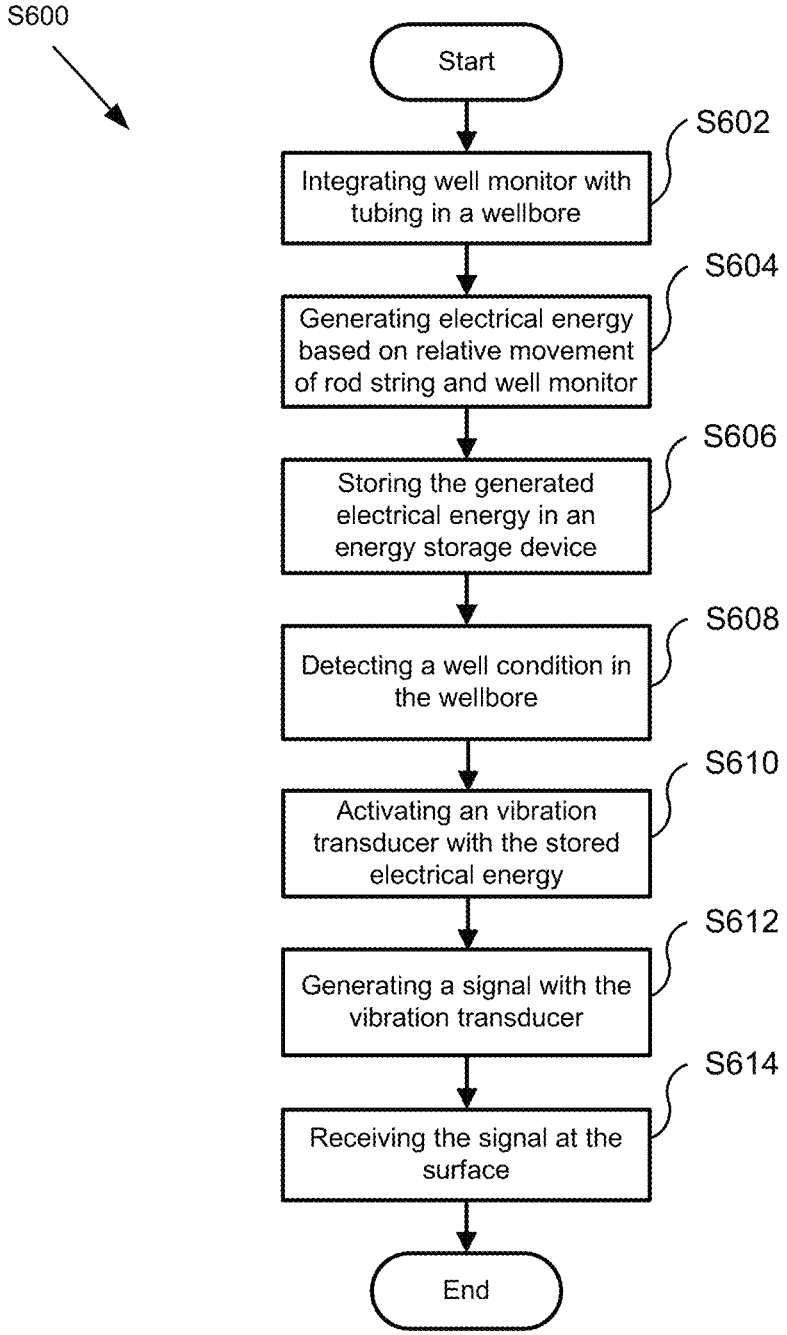
FIG. 13 is a flow chart depicting a method of using the well monitor of FIG. 2 to communicate a well condition of the well to the surface.

FIG. 13 depicts a method S600 of using the well monitor 200 to communicate a well condition of the wellbore 104 to the surface.

At block S602, the well monitor 200 may be integrated with the tubing 114 and received in the wellbore 104. The controller 300 may be pre-programmed to synchronize with the surface receiver 142 for periodically generating, sending, and receiving signals indicative of the well condition of the wellbore 104. In some embodiments, the well monitor 200 may be coupled to the tubing 114 with the uphole collar 202 and the downhole collar 204.

In some embodiments, when the well monitor 200 is integrated with the tubing 114 and received in the wellbore 104, or during the initial period of operation of the artificial lift system 110, the one or more energy storage devices of the well monitor 200 are not sufficiently charged to power the vibration transducer 400. In some embodiments, where the well monitor 200 comprises two or more energy storage devices, such as the capacitor bank 256 and the battery bank 260, the controller 300 may be configured to send a control command to the battery to capacitor charge circuitry 262 for the batteries of the battery bank 260 to charge the capacitors of the capacitor bank 256, such that the capacitors of the capacitor bank 256 are sufficiently charged for powering the vibration transducer 400 to generate a signal indicative of the well condition of the wellbore 104.

At block S604, as the prime mover 124 moves the rod string 117 to operate the pump 118 to pump fluid in the tubing 116 to the surface 10, the electrical generator assembly 210 of the well monitor 200 may generate electrical energy based on relative movement of magnets 214 and windings 216 by the rod 116. As depicted in FIG. 2, FIG. 3, and FIG. 4A, the magnets 214 of the electrical generator 212 of the electrical generator assembly 210 are mounted onto the rod 116, and the windings 216 are mounted on the electrical generator assembly 210. The electric generator assembly 210 is electrically coupled to the electronics mandrel assembly 250 for storing the generated electrical energy.

At block S606, the electrical energy generated by the electrical generator assembly 210 is stored in an energy storage device. As depicted in FIG. 6, the well monitor 200 comprises two energy storage devices, the capacitor bank 256 and the battery bank 260. The controller 300 is configured to send control commands to the capacitor charge and regulation circuitry 254, the battery charge and regulation circuitry 258, and the battery to capacitor charge circuitry 262 for the circuitries to connect the rectifier 252, the capacitor bank 256, and the battery bank 260, to direct the electrical energy to charge the capacitors of the capacitor bank 256 and to charge the batteries of the battery bank 260. In some embodiments, the controller 300 controls the connection between the rectifier 252, the capacitor bank 256, and the battery bank 260 such that the capacitors of the capacitor bank 256 are sufficiently charged before the batteries of the battery bank 260 are charged.

At block S608, a well condition of the wellbore 104 is detected by the well monitor 200, for example, by the sensors 302. For example, the sensors 302 may include acoustic sensors such as microphones, sensors capable of detecting seismic vibrations, ultrasound sensors, electromagnetic sensors, pressure sensors for the annular passage 132 of the wellbore 104, pressure sensors for the discharge of the pump 118, temperature sensors, sensors for monitoring the movement, speed, vibration, and position of the rod string 117, or a combination thereof.

The controller 300 decodes the signals indicative of the well condition that are sent from the sensors 302 to the controller 300, for example, into a string of binary data, that may be encoded for communication to the surface 10. As described herein, the controller 300 may encode the signals using (2, 3)-ary encoding for communicating the well condition to the surface 10.

At block S610, based on the encoded signals, a sufficient voltage is applied to the vibration transducer 400 using the electrical energy stored in the energy storage device to power the vibration transducer 400 and generate a signal. As depicted in FIG. 6, the controller 300 may send a control command to the vibration transducer drive circuitry 264 to connect the capacitor bank 256 and the vibration transducer 400, and to electrically communicate the capacitors of the capacitor bank 256 and the vibration transducer 400. In some embodiments, the capacitor bank 256 and the vibration transducer 400 is disconnected or connected via the vibration transducer drive circuitry 264 based on the particular time window 354 within the particular time interval 352 during which the pulse 356 is to be triggered, in accordance with the signal indicative of the well condition encoded using (2, 3)-ary encoding, for the vibration transducer 400 to generate a signal to be received at the surface 10 that corresponds to the encoded signal.

In some embodiments, as depicted in FIG. 6, the electrical energy directed from the capacitor bank 256 to the vibration transducer 400 first is first conducted through the H-bridge circuit of the vibration transducer drive circuitry 264 and step-up transformer 266 prior to powering the vibration transducer 400.

At block S612, when a sufficient voltage is applied to the vibration transducer 400 by the electrical energy stored in the energy storage device to power the vibration transducer 400, such as the capacitor bank 256, the vibration transducer 400 generates a signal. In some embodiments, where the vibration transducer 400 is the piezoelectric transducer, the vibration transducer 400 generates stress waves that traverse through the tubing 114 to the surface 10.

At block S614, the signal generated by the vibration transducer 400 is received at the surface 10 by the surface receiver 140. The surface receiver 140 may decode the signal and process the decoded signal to determine the well condition of the wellbore 104. For example, the surface receiver 140 may process the decoded signal, such as the pressure in the annular passage 132, to determine the annulus fluid level 138 in the wellbore 104 as detected by the sensors 302 of the well monitor 200. The surface receiver 140 may display the well condition of the wellbore 104 on a display screen of the surface receiver 140. The surface receiver 140 may send a control command to the artificial lift system 110 for controlling the efficiency of producing fluids from the wellbore 104. For example, based on the annulus fluid level 138 in the wellbore 104, the surface receiver 140 may send a control command to change the speed of the prime mover 124 and improve the efficiency of the artificial lift system 110 for producing fluids from the wellbore 104. The surface receiver 140 may comprise an input device for receiving inputs, for example, from a user, for controlling the artificial lift system 110, such as the speed of the prime mover 124.

In some embodiments, the surface receiver 140 is in data communication with a SCADA system or an electronic device via the communication link 142. The SCADA system or the electronic device may comprise the processing components for decoding the signals and the display components for displaying the decoded signals that are generated by the vibration transducer 400, and may further comprise the control components and input components for improving the efficiency of the artificial lift system 110.

As described above, the windings 216 of the well monitor 200, as depicted in FIG. 2, FIG. 3, and FIG. 4A, are mounted about the circumference of the electric generator assembly 210 and encircling the magnets 214 such that the well monitor 200 may be used with an artificial lift system 110 where the pump 118 is a progressive cavity pump, as depicted in FIG. 1.

Figure 14A:
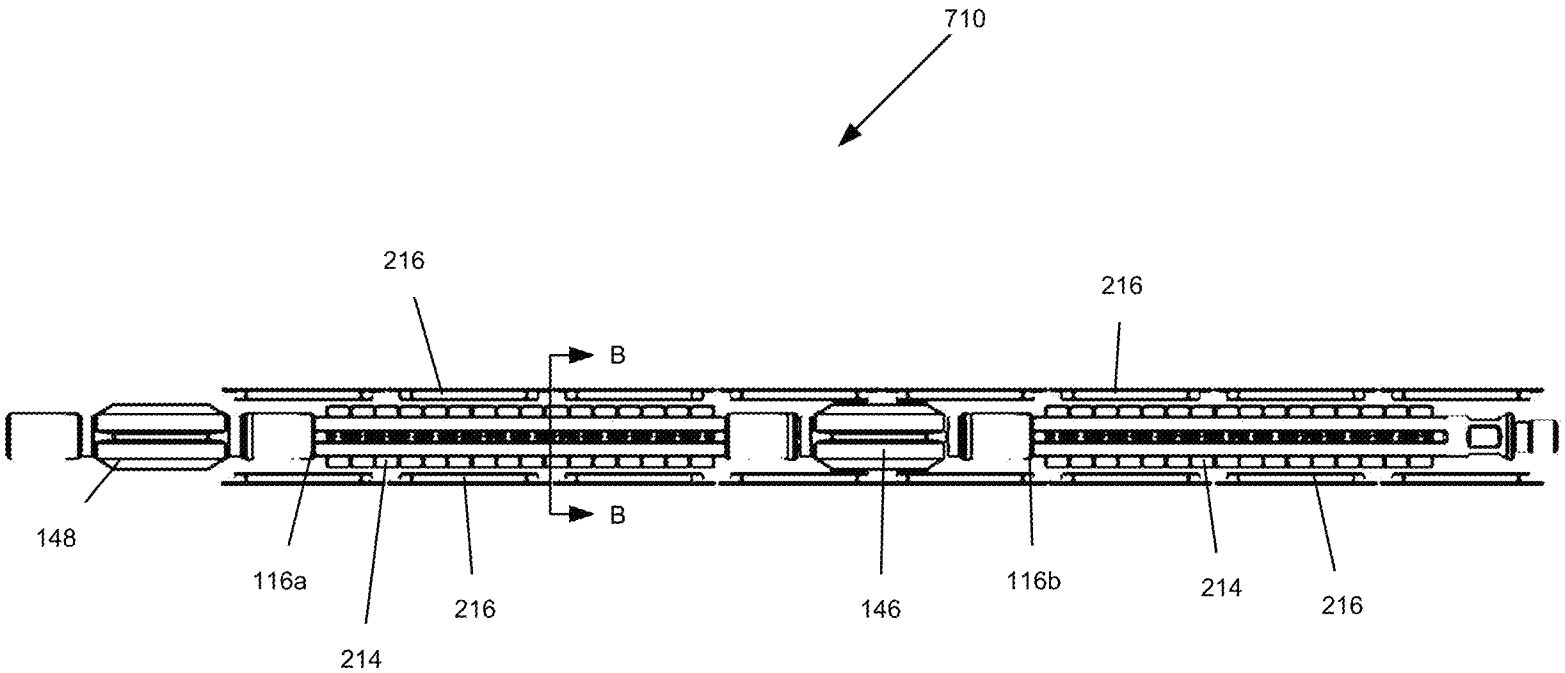
FIG. 14A is a cross-sectional view of an electric generator assembly of another well monitor.
Figure 14B:
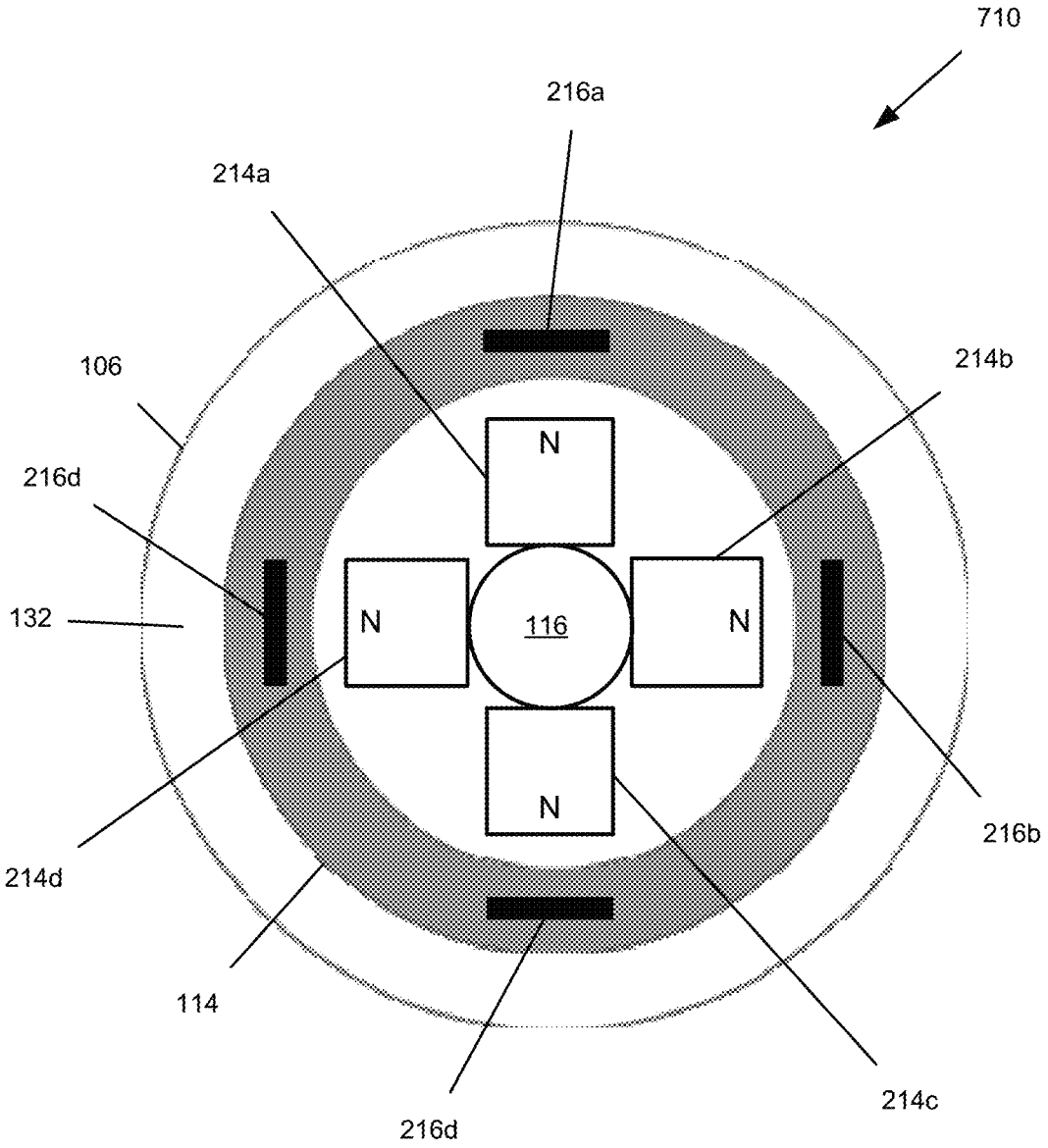
FIG. 14B is a schematic of a cross-sectional view of the electric generator assembly of FIG. 14A along line B-B shown in FIG. 14A.
Figure 15:
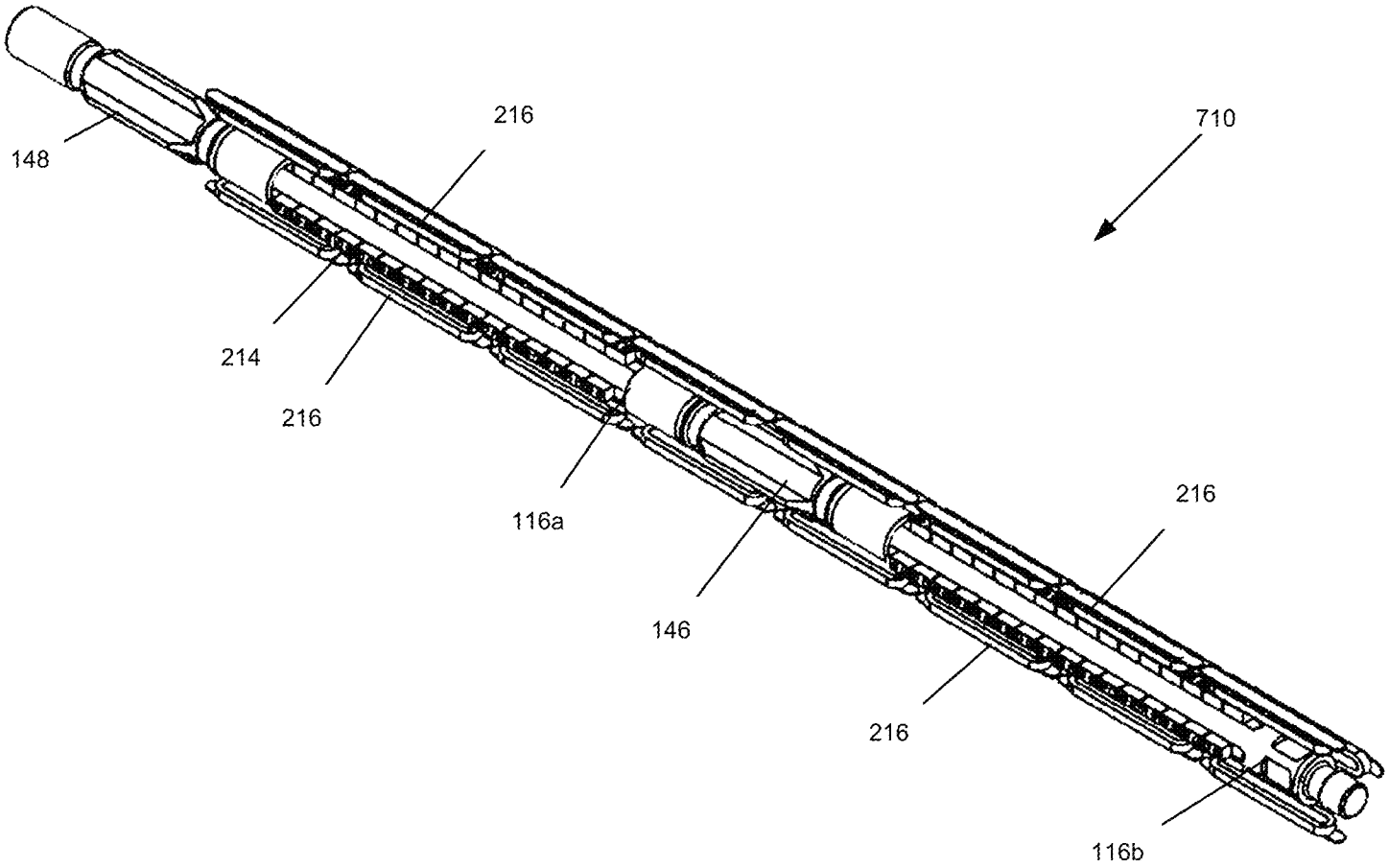
FIG. 15 is a perspective cutaway view of the electric generator assembly of FIG. 14A.

Other configurations of the magnets 214 and the windings 216 are possible, such that the well monitor 200 may be used with an artificial lift system 110 where the pump 118 is a sucker rod pump. FIG. 14A is a cross-sectional view of an electric generator assembly 710 of the well monitor 200 that may be used with the artificial lift system 110 where the pump 118 is a sucker rod pump. FIG. 14B is a cross-sectional view of the electric generator assembly 710 of FIG. 14A along line B-B shown in FIG. 14A. FIG. 15 is a perspective cutaway view of the electric generator assembly 710.

Similar to the electric generator assembly 210, the electric generator assembly 710 receives a portion of the rod string 117 through the electric generator assembly 710. One or more centralizers may be mounted to the rod string 117 to maintain clearance between the rod string 117 and the electric generator assembly 710. In some embodiments, two centralizers are mounted to the rod string 117 to separate rods 116. As depicted in FIG. 14A and FIG. 15, the uphole 146 centralizer is mounted onto an uphole end of a rod 116*a*. As depicted in FIG. 14A, the downhole centralizer 148 is mounted onto a downhole end of the rod 116*a*. The electric generator assembly 710 is electrically coupled to the electronics mandrel assembly 250.

In some embodiments, the electric generator assembly 710 comprises magnets 214 that are mounted onto the rod 116. As depicted in FIG. 14A and FIG. 15, the magnets 214 may be mounted onto the rod 116 in rows. The magnets 214 of a row of magnets 214 have alternating poles exposed to the windings 216. For example, first, second, and third magnets 214 may be mounted on the rod 116 in a row, and the north pole of the first magnet 214 is exposed to the windings 216, the south pole of the second magnet 214 longitudinally adjacent the first magnet 214 is exposed to the windings 216, and the north pole of the third magnet 214 longitudinally adjacent the second magnet 214 is exposed to the windings 216. In some embodiments, the row of magnets 214 may have a length generally similar to the stroke length of the rod string 117, which allows the windings 216 to be continuously exposed to alternating magnetic flux during the reciprocating motion of the rod string 117.

In some embodiments, the windings 216 are mounted longitudinally along the electric generator assembly 710, such that the windings 216 are configured to have linear poles, and the windings 216 together define rows of windings 216. The rows of windings 216 may be mounted on the electric generator assembly 710 and opposing a corresponding row of magnets 214. As depicted in FIG. 15, the windings 216 are wound as cores and received in slots that align longitudinally along the electric generator assembly 710 and oppose the magnets 214. As depicted in FIG. 14A, FIG. 14B, and FIG. 15, the electric generator assembly 710 comprises four rows of windings 216*a*, 216*b*, 216*c*, and 216*d*, each row of windings 216 mounted generally opposite a corresponding row of magnets 214*a*, 214*b*, 214*c*, and 214*d*. In some embodiments, the electric generator assembly 710 may have more than or fewer than four rows of windings 216, each row of windings 216 mounted generally evenly apart from each other. In some examples, a row of windings 216 comprises 8 bundles of windings 216. In some examples, a row of windings 216 comprises 10 bundles of windings 216. In some embodiments, there are sufficient windings 216 mounted along the electric generator assembly 710 such that at least one bundle of windings 216 are exposed to the magnetic field of the magnets 214 at any point during the reciprocating up and down movement of the rod 116.

In some embodiments, the poles of the magnets 214 mounted about a common circumference of the rod 116 that are proximate to the windings 216 of the electric generator assembly 710 are the same. As depicted in FIG. 14B, the magnets 214*a*, 214*b*, 214*c*, and 214*d* are mounted on the rod 116 about a common circumference of the rod 116, and the north pole of each magnet 214*a*, 214*b*, 214*c*, and 214*d* are proximate to the windings 216.

In some embodiments, the electric generator assembly 710 may receive a plurality of rods 116 with the magnets 214 mounted thereon with alternating centralizers 146 and 148. The number of rods 116 received in the electric generator assembly 710 may be based on the stroke length of the rod string 117, and the number of centralizers 146 and 148 required to prevent the magnets 214 from sliding against the electric generator assembly 710. As depicted in FIG. 14A and FIG. 15, the electric generator assembly 710 is receiving the two rods 116*a* and 116*b*, with the magnets 214 mounted thereon.

When the pump 118 is a sucker rod pump, the prime mover 124 drives the rod string 117 to move in a reciprocating motion generally in an up and down direction along the wellbore 104. During the reciprocating up and down movement of the rod string 117 during operation of the pump 118, the magnets 214 mounted on the rod 116 are movable relative to the windings 216, such that the electrical generator assembly 710 generates electrical energy. Where the magnets 214 of a row of magnets 214 have alternating poles exposed to the windings 216, the windings 216 are exposed to alternating poles during the reciprocating motion of the rod string 117, thereby generating electrical energy. The generated electrical energy may be directed to the electronics mandrel assembly 250 to be stored in the one or more energy storage devices, such as the capacitor bank 256 and the battery bank 260. In some examples, the well monitor 200 comprising the electrical generator assembly 710 is positioned downhole in the wellbore 104 approximately 6,000 feet for generating electrical energy with the pump 118 that is a sucker rod pump.

As described above, the magnets 214 of the well monitor 200, as depicted in FIG. 2, FIG. 3, and FIG. 4A, are mounted on the rod 116, and the windings 216 are mounted on the electric generator assembly 210.

Figure 16:
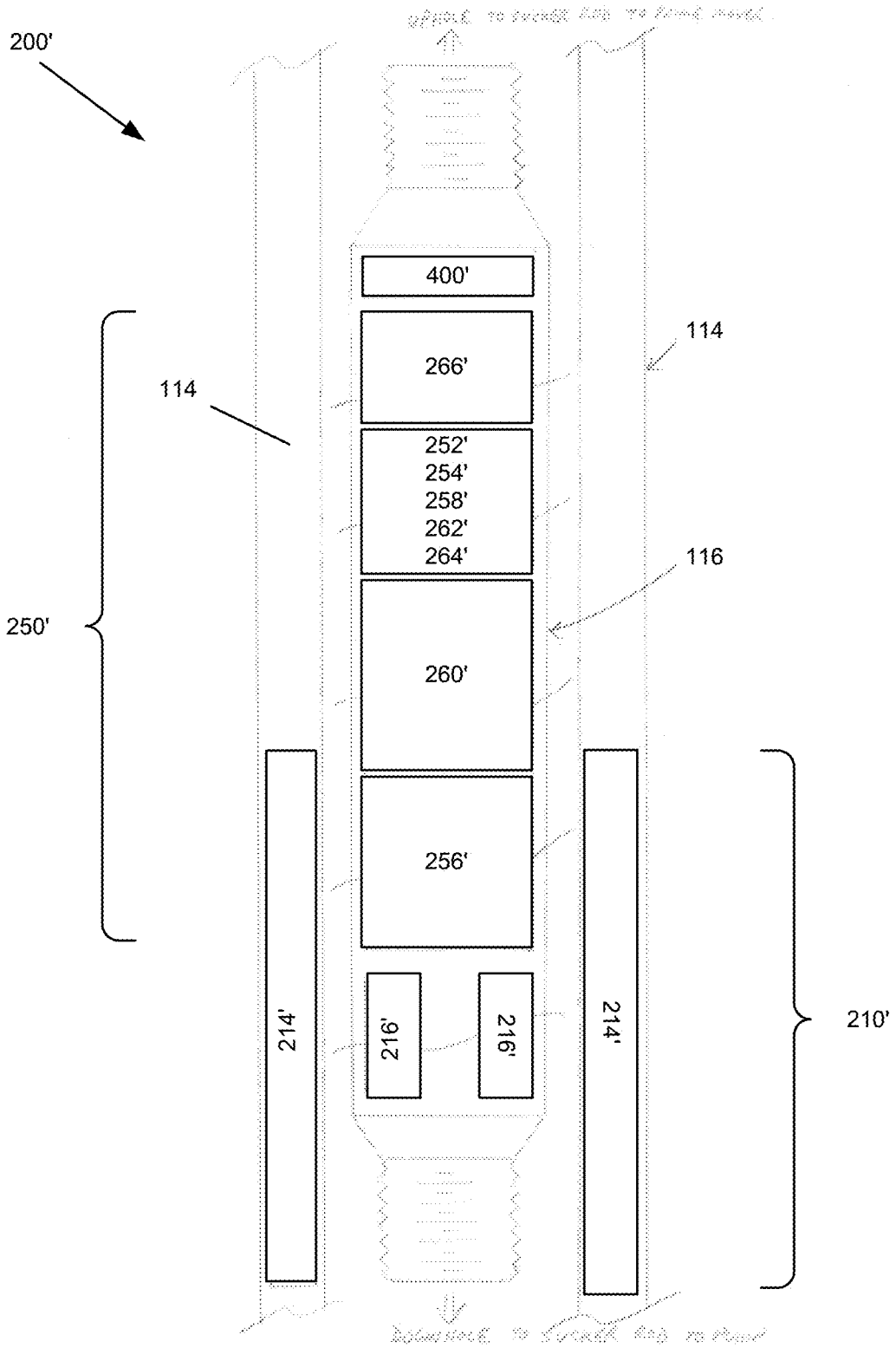
FIG. 16 is a schematic of another well monitor.

Other configurations of the magnets 214 and the windings 216 are possible. FIG. 16 depicts a well monitor 200', where the windings 216' are mounted on the rod 116, and the magnets 214' are mounted on the electric generator assembly 210, such that the windings 216' are movable relative to the magnets 214'.

Similar to the well monitor 200, the well monitor 200' comprises an electric generator assembly 210' that generates electrical energy based on relative movement of the magnets 214' and windings 216', except the windings 216' move relative to the magnets 214' mounted to the electric generator assembly 210'.

The well monitor 200' comprises an electronics assembly 250' in electrical communication with the electric generator assembly 210' for storing the electrical energy generated by the electrical generator assembly 210'. The electronics assembly 250' is mounted to the rod 116. As depicted in FIG. 16, the electronics assembly 250' comprises a capacitor bank 256', a battery bank 260', a rectifier 252', capacitor charge and regulation circuitry 254', battery charge and regulation circuitry 258', battery to capacitor charge circuitry 262', vibration transducer drive circuitry 264', and a step up transformer 266' for storing the electrical energy generated by the electric generator 210', and applying a sufficient voltage to a vibration transducer 400', generally similar to vibration transducer 400, to generate a signal.

The electronics assembly 250' comprises a controller, generally similar to controller 300, that is configured to selectively apply a sufficient voltage to the vibration transducer 400' for the vibration transducer 400' to generate a signal, corresponding to a well condition detected by one or more sensors that may be mounted to the electronics assembly 250', that traverses to the surface 10 through the rod 116 and is received by a surface receiver 140 for processing. The controller 300' is programmed to encode the well condition signal using (N, M)-ary encoding, such as (2, 3)-ary encoding, and selectively connect the energy storage devices of the electronics assembly 250' (e.g. the capacitor bank 256') to the vibration transducer 400', based on the encoded well condition signal, such that electrical energy may flow from the capacitor bank 256' to the vibration transducer 400' for the vibration transducer 400' to generate a signal corresponding to the well condition.

In some embodiments, the rod 116 on which the windings 216', electronics assembly 250', and vibration transducer 400' is mounted is a pony rod for aligning the windings 216' mounted on the rod 116 with the magnets 214' mounted on the electric generator assembly 210'.

The preceding discussion provides many example embodiments. Although each embodiment represents a single combination of inventive elements, other examples may include all suitable combinations of the disclosed elements. Thus if one embodiment comprises elements A, B, and C, and a second embodiment comprises elements B and D, other remaining combinations of A, B, C, or D, may also be used.

The term "connected" or "coupled to" may include both direct coupling (in which two elements that are coupled to each other contact each other) and indirect coupling (in which at least one additional element is located between the two elements).

Although the embodiments have been described in detail, it should be understood that various changes, substitutions and alterations can be made herein.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized. Accordingly, the appended claims are intended to include within their scope such processes, machines, manufacture, compositions of matter, means, methods, or steps.

As can be understood, the examples described above and illustrated are intended to be examples only. The invention is defined by the appended claims.

What is claimed is:

1. A well monitor for monitoring a downhole well condition of a well configured for production of reservoir fluid from a subterranean formation, wherein:

the well monitor is configured to be connected to a first tubing portion and a second tubing portion, the connection of the well monitor to the first tubing portion and the second tubing portion is such that a production tubing is established;

while the production tubing is established, a tubing passage, for receiving an artificial lift system having a pump rod, is defined;

while the production tubing is emplaced within the well, the artificial lift system and the production tubing are co-operatively configured to induce flow of reservoir fluid through the tubing passage for the production of the reservoir fluid;

the well monitor comprises:

an electrical generator, comprising:

magnets;

windings;

wherein, while: 1) the artificial lift system is received in the tubing passage, and 2) the magnets are mounted to the pump rod, the magnets are movable relative to the windings in response to movement of the pump rod in the tubing passage to generate electrical energy;

an energy storage device electrically coupled to the generator for storing generated electrical energy;

a vibration transducer electrically coupled to the energy storage device, the vibration transducer comprising a plurality of piezo stacks, and each piezo stack of the plurality of piezo stacks, independently, comprising a plurality of piezo elements, the plurality of piezo stacks are co-operatively configured such that a ring of piezo stacks is defined, the plurality of piezo stacks of the ring of piezo stacks including a first piezo stack and a second piezo stack that are disposed in a spaced apart relationship, the vibration transducer further defining a production fluid flow channel that defines a portion of the tubing passage and that extends through the ring of piezo stacks, such that, while (i) the production tubing is disposed in the well, and (ii) the pump rod is extended through the production fluid flow channel:

the flow of reservoir fluid, which is induced via the co-operation between the artificial lift system and the production tubing, is flowable through the production fluid flow channel for effecting the production of the reservoir fluid; and a controller for selectively powering the vibration transducer to produce a signal indicative of the well condition for transmission through the production tubing.

2. The well monitor of claim 1, wherein the well monitor comprises a sensor for detecting the well condition.

3. The well monitor of claim 2, wherein the controller comprises a processor configured to:

receive a signal representative of the well condition from the sensor;

encode the signal representative of the well condition; and trigger the energy storage device to power the vibration transducer to generate the signal indicative of the well condition through the production tubing.

4. The well monitor of claim 1, wherein the signal comprises a stress wave introduced in said production tubing by the vibration transducer.

5. The well monitor of claim 4, further comprising a rectifier and a step-up transformer interposed between the energy storage device and the vibration transducer, such that a voltage applied to the vibration transducer is greater than a voltage stored by the energy storage device.

6. The well monitor of claim 4, wherein the stress wave is a first stress wave traversing through the production tubing in an uphole direction, the signal further comprises a second stress wave traversing through the production tubing in a downhole direction, the well monitor further comprising a passive reflector positioned downhole of the vibration transducer, the passive reflector having a length for phase shifting the second stress wave such that, while the second stress wave, traversing in the downhole direction along the length of the passive reflector, is reflected to traverse in the uphole direction along the length of the passive reflector, such that a reflected second stress wave is defined, the reflected second stress wave is phase shifted such that the reflected second stress wave combines constructively with the first stress wave generated by the vibration transducer that is traversing in the uphole direction.

7. The well monitor of claim 6, wherein while the reflected second stress wave is defined, the reflected second stress wave is phase shifted by the passive reflector by half a wavelength of the second stress wave, such that the reflected second stress wave combines constructively with the first stress wave generated by the vibration transducer that is traversing in the uphole direction.

8. The well monitor of claim 1, wherein the signal comprises a frequency between 600 Hz and 650 Hz.

9. The well monitor of claim 1, wherein the energy storage device is a capacitor.

10. The well monitor of claim 9, wherein the energy storage device is a supercapacitor.

11. The well monitor of claim 1, wherein the energy storage device is a first energy storage device, the well monitor further comprising a second energy storage device, and wherein the first energy storage device is a supercapacitor, and the second energy storage device is a battery.

12. The well monitor of claim 1, wherein the artificial lift system is a progressive cavity pumping system.

13. The well monitor of claim 1, wherein the rod is coupled to a reciprocating rod system.

14. The well monitor of claim 1, wherein:

the first tubing portion is an uphole tubing portion, and the second tubing portion is a downhole tubing portion, such that, while the well monitor is connected to the uphole tubing portion and the downhole tubing portion to establish the production tubing, the uphole tubing portion is disposed uphole of the well monitor, and the downhole tubing portion is disposed downhole of the well monitor.

15. The well monitor of claim 14, wherein, while the well monitor is connected to the uphole tubing portion and the downhole tubing portion to establish the production tubing, the vibration transducer is disposed in line with the production tubing such that the signal produced by the vibration transducer is communicated directly to the production tubing for transmission through the production tubing.

16. The well monitor of claim 1, wherein the production fluid flow channel is defined at the center of the vibration transducer.

17. The well monitor of claim 1, wherein, for each piezo stack of the plurality of piezo stacks, the piezo stack is disposed in an offset relationship relative to the production fluid flow channel.

18. The well monitor of claim 1, wherein the production fluid flow channel is disposed between the first piezo stack and the second piezo stack.

19. The well monitor of claim 1, wherein the first piezo stack and the second piezo stack are further disposed in an adjacent relationship.

20. The well monitor of claim 1, wherein the plurality of piezo stacks are disposed around the production fluid flow channel.

21. A method of monitoring a downhole well condition of a well configured for production of reservoir fluid from a subterranean formation, wherein a production tubing is emplaced within the well, the production tubing defining a tubing passage to receive an artificial lift system having a pump rod, the artificial lift system and the production tubing co-operatively configured to induce flow of reservoir fluid for the production of the reservoir fluid, the method comprising:

inducing, via cyclical motion of the pump rod, flow of reservoir fluid for the production of the reservoir fluid;

generating electrical energy at an electrical generator, by the cyclical motion of the pump rod, the electrical generator comprising:

magnets;

windings;

wherein, while: 1) the artificial lift system is received in the tubing passage, and 2) the magnets are mounted to the pump rod, the magnets are movable relative to the windings in response to movement of the pump rod in the tubing to generate electrical energy;

charging an energy storage device with the electrical energy; and selectively powering a vibration transducer via the energy storage device to produce a signal indicative of the well condition for transmission through the production tubing, the vibration transducer comprising a plurality of piezo stacks, and each piezo stack of the plurality of piezo stacks, independently, comprising a plurality of piezo elements, the plurality of piezo stacks are co-operatively configured such that a ring of piezo stacks is defined, the plurality of piezo stacks of the ring of piezo stacks including a first piezo stack and a second piezo stack that are disposed in a spaced apart relationship;

wherein:

the pump rod is extended through a production fluid flow channel defined by the vibration transducer, the production fluid flow channel defining a portion of the tubing passage and extending through the ring of piezo stacks; and the flow of reservoir fluid, which is induced via the co-operation between the artificial lift system and the production tubing, flows through the production fluid flow channel for effecting the production of the reservoir fluid.

22. The method of claim 21, further comprising:

detecting the well condition with a sensor;

encoding the signal; and selectively powering the vibration transducer using a controller to produce the encoded signal.

23. The method of claim 21, wherein the selectively powering comprises applying a voltage stored in the energy storage device to the vibration transducer.

24. The method of claim 23, wherein the selectively powering comprises increasing the voltage with a step-up transformer.

25. The method of claim 23, wherein the selectively powering comprises applying an alternating voltage to the vibration transducer.

26. The method of claim 21, wherein the cyclical motion of the pump rod is a rotational motion.

27. The method of claim 21, wherein the cyclical motion of the pump rod is a reciprocating up and down motion.

28. The method of claim 21, wherein the production fluid flow channel is defined at the center of the vibration transducer.

29. The method of claim 21, wherein, for each piezo stack of the plurality of piezo stacks, the piezo stack is disposed in an offset relationship relative to the production fluid flow channel.

30. The method of claim 21, wherein the production fluid flow channel is disposed between the first piezo stack and the second piezo stack.

31. The method of claim 21, wherein the first piezo stack and the second piezo stack are further disposed in an adjacent relationship.

32. The method of claim 21, wherein the plurality of piezo stacks are disposed around the production fluid flow channel.

33. A well monitor for monitoring a downhole well condition of a well configured for production of reservoir fluid from a subterranean formation, wherein:

the well monitor is configured to be connected to a first tubing portion and a second tubing portion, the connection of the well monitor to the first tubing portion and the second tubing portion is such that a production tubing is established;

while the production tubing is established, a tubing passage, for receiving an artificial lift system having a pump rod, is defined;

while the production tubing is emplaced within the well, the artificial lift system and the production tubing are co-operatively configured to induce flow of reservoir fluid through the tubing passage for the production of the reservoir fluid;

the well monitor comprises:

an electrical generator, comprising:

magnets;

windings;

wherein, while: 1) the artificial lift system is received in the tubing passage, and 2) the windings are mounted to the pump rod, the windings are movable relative to the magnets in response to movement of the pump rod in the tubing passage to generate electrical energy;

an energy storage device electrically coupled to the generator for storing electrical energy generated by the electrical generator;

a vibration transducer electrically coupled to the energy storage device, the vibration transducer comprising a plurality of piezo stacks, each piezo stack of the plurality of piezo stacks, independently, comprising a plurality of piezo elements, the plurality of piezo stacks are co-operatively configured such that a ring of piezo stacks is defined, the plurality of piezo stacks of the ring of piezo stacks including a first piezo stack and a second piezo stack that are disposed in a spaced apart relationship, the vibration transducer further defining a production fluid flow channel that defines a portion of the tubing passage and that extends through the ring of piezo stacks, such that, while (i) the production tubing is disposed in the well, and (ii) the pump rod is extended through the production fluid flow channel:

the flow of reservoir fluid, which is induced via the co-operation between the artificial lift system and the production tubing, is flowable through the production fluid flow channel for effecting the production of the reservoir fluid; and a controller for selectively powering the vibration transducer with the electrical energy stored in the energy storage device to produce a signal indicative of the well condition for transmission through the production tubing.

34. The well monitor of claim 33, wherein the production fluid flow channel is defined at the center of the vibration transducer.

35. The well monitor of claim 33, wherein, for each piezo stack of the plurality of piezo stacks, the piezo stack is disposed in an offset relationship relative to the production fluid flow channel.

36. The well monitor of claim 33, wherein the production fluid flow channel is disposed between the first piezo stack and the second piezo stack.

37. The well monitor of claim 33, wherein the first piezo stack and the second piezo stack are further disposed in an adjacent relationship.

38. The well monitor of claim 33, wherein the plurality of piezo stacks are disposed around the production fluid flow channel.

* * * * *